US011560727B2

(12) United States Patent
Ligman et al.

(10) Patent No.: US 11,560,727 B2
(45) Date of Patent: Jan. 24, 2023

(54) APPARATUS FOR SCREEDING CONCRETE

(71) Applicant: Ligchine International Corporation, Floyds Knobs, IN (US)

(72) Inventors: Peter A. Ligman, Darien, WI (US); Gary Ligman, Jeffersonville, IN (US)

(73) Assignee: Ligchine International Corporation, Floyds Knobs, IN (US)

( * ) Notice: Subject to any disclaimer, the term of this patent is extended or adjusted under 35 U.S.C. 154(b) by 0 days.

(21) Appl. No.: 16/550,864

(22) Filed: Aug. 26, 2019

(65) Prior Publication Data

US 2020/0109573 A1 Apr. 9, 2020

Related U.S. Application Data

(60) Provisional application No. 62/742,748, filed on Oct. 8, 2018.

(51) Int. Cl.

| | |
|---|---|
| ***E01C 19/40*** | (2006.01) |
| ***E04G 21/10*** | (2006.01) |
| ***E04F 21/24*** | (2006.01) |
| ***E01C 19/42*** | (2006.01) |

(52) U.S. Cl.

CPC ..... *E04G 21/10* (2013.01); *E01C 19/40* (2013.01); *E01C 19/42* (2013.01); *E04F 21/242* (2013.01)

(58) Field of Classification Search

CPC ..... E01C 19/40; E01C 19/42; E04F 21/242; E04G 21/10

USPC ..... 404/84.05–84.5, 104, 118, 120

See application file for complete search history.

(56) References Cited

U.S. PATENT DOCUMENTS

| | | | | |
|---|---|---|---|---|
| 1,284,385 | A | 11/1918 | Linden | |
| 1,731,231 | A | 10/1929 | Chenoweth | |
| 2,116,816 | A | 5/1938 | Kaspar | |
| 2,403,812 | A | 7/1946 | Maccallum | |
| 2,636,290 | A | 4/1953 | Bell | |
| 3,341,029 | A | 9/1967 | Barkley et al. | |
| 3,377,933 | A | 4/1968 | Dale | |
| 3,675,721 | A | 7/1972 | Davidson et al. | |
| 3,721,054 | A | 3/1973 | Hornagold | |
| 3,749,504 | A * | 7/1973 | Smith | B62D 55/116 404/84.2 |

(Continued)

FOREIGN PATENT DOCUMENTS

| | | |
|---|---|---|
| EP | 1267000 A2 | 12/2002 |
| ES | 2247952 A1 | 3/2006 |

(Continued)

OTHER PUBLICATIONS

European Patent Office; International Search Report and Written Opinion for PCT App. No. PCT/US2019/051694 dated Nov. 7, 2019.

(Continued)

*Primary Examiner* — Raymond W Addie

(74) *Attorney, Agent, or Firm* — Dinsmore & Shohl LLP; Alexander P. Brackett

(57) ABSTRACT

An apparatus for screeding concrete to produce a level finished surface includes a frame assembly having an integral screed head having at least one member for contacting said concrete, a leveling assembly secured to the frame assembly having a plurality of vertically adjustable leveling legs capable of extension and retraction and a plurality of wheels secured to the leveling legs, each capable of rotation around a vertical axis for steering.

21 Claims, 18 Drawing Sheets

(56) References Cited

U.S. PATENT DOCUMENTS 3,840,125 A 10/1974 Cozad
3,870,427 A 3/1975 Allen
3,901,616 A 8/1975 Greening
3,953,052 A 4/1976 Palmcrantz
3,966,345 A 6/1976 Kofel
3,969,035 A 7/1976 Silbernagel
3,970,405 A * 7/1976 Swisher, Jr. ..... E01C 19/405 404/105
4,029,165 A 6/1977 Miller
4,036,372 A 7/1977 Rao et al.
4,084,777 A 4/1978 Lambert
4,192,626 A 3/1980 Wyckoff
4,231,678 A 11/1980 Cartemock
4,363,409 A 12/1982 Laurich-Trost
4,406,375 A 9/1983 Hockensmith
4,422,795 A 12/1983 Berrange
4,566,823 A * 1/1986 May ..... E01C 19/4893 404/98
4,655,633 A 4/1987 Somero et al.
4,700,786 A 10/1987 Berry
4,770,304 A 9/1988 Woods
4,789,266 A * 12/1988 Clarke, Jr. ..... E01C 19/187 404/104
4,869,618 A 9/1989 Morrison
4,896,995 A 1/1990 Simmons
4,930,935 A 6/1990 Quenzie et al.
4,936,763 A * 6/1990 Thomas ..... E01C 19/4893 264/33
4,978,246 A 12/1990 Quenzi et al.
4,988,233 A 1/1991 Kasler
5,009,546 A 4/1991 Domenighetti et al.
5,018,555 A * 5/1991 Hawerkamp ..... E21B 17/04 138/109
5,039,249 A 8/1991 Hansen et al.
5,045,025 A 9/1991 Underwood
5,051,025 A * 9/1991 Taylor, Jr. ..... E01C 19/4893 404/98
5,129,803 A 7/1992 Nomura
5,192,102 A 3/1993 Mertens
5,217,320 A 6/1993 Cioffi
5,224,793 A 7/1993 De Pol
5,234,128 A 8/1993 Hill
5,234,281 A 8/1993 Somero et al.
5,244,305 A 9/1993 Lindley
5,348,418 A 9/1994 Campbell
5,375,942 A 12/1994 Lindley
5,515,654 A 5/1996 Anderson
5,533,831 A 7/1996 Allen
5,556,226 A 9/1996 Hohmann, Jr.
5,567,075 A 10/1996 Allen
6,129,481 A 10/2000 Tapio et al.
6,155,708 A 12/2000 Lindley
6,203,244 B1 3/2001 Van Ornum
6,227,761 B1 5/2001 Kieranen
6,325,531 B1 12/2001 Lindley
6,328,115 B1 12/2001 Carter, Jr.
6,447,204 B1 9/2002 McDonald
6,481,924 B1 11/2002 Smolders et al.
6,485,227 B1 11/2002 Mathiowetz
6,508,606 B1 1/2003 James
6,530,721 B2 3/2003 Yost
6,554,532 B1 4/2003 Motz
6,695,532 B2 2/2004 Somero et al.
6,729,796 B1 5/2004 Green
6,843,615 B1 1/2005 Cook
6,857,816 B2 2/2005 Saito et al.
6,860,676 B2 3/2005 Pont Feixes
7,004,675 B2 2/2006 Wayne
7,044,681 B2 5/2006 Quenzie et al.
7,121,762 B2 * 10/2006 Quenzi ..... E01C 19/006 404/84.1
7,144,191 B2 12/2006 Kieranen et al.
7,172,363 B2 2/2007 Olson
7,175,363 B2 2/2007 Quenzi et al.
7,195,423 B2 * 3/2007 Halonen ..... E01C 19/42 404/84.5
7,195,424 B2 3/2007 Lindley
7,232,277 B2 6/2007 Corbitt
7,311,466 B2 12/2007 Torvinen
7,320,558 B2 1/2008 Quenzie et al.
7,328,810 B1 2/2008 Rhodes
7,396,186 B2 7/2008 Quenzie et al.
7,399,139 B2 7/2008 Kieranen et al.
7,407,339 B2 8/2008 Halonen et al.
7,497,140 B2 3/2009 Blackwelder et al.
7,540,685 B2 6/2009 Avikainen
7,540,686 B2 6/2009 Heims
7,540,687 B2 6/2009 Neumann
7,559,719 B2 7/2009 Nasby
7,621,694 B1 11/2009 Goodman
7,685,929 B2 3/2010 Mainville
7,748,789 B2 7/2010 Freeburn
7,775,742 B2 8/2010 Buijsman
7,850,396 B2 12/2010 Pietila
7,854,565 B2 12/2010 Halonen
7,874,571 B2 1/2011 Frey
7,909,533 B2 3/2011 Quenzi
8,128,390 B2 * 3/2012 O'Hara ..... E04G 11/20 425/63
8,152,409 B1 * 4/2012 Ligman ..... E01C 19/405 404/118
8,220,806 B2 * 7/2012 Neudeck ..... B24B 7/188 299/1.5
8,322,947 B2 12/2012 Neumann
8,591,142 B2 11/2013 Mittleman
8,657,215 B1 2/2014 Blum
8,794,868 B2 8/2014 Fritz
9,180,909 B1 11/2015 Coats
9,199,828 B2 12/2015 Steinich
9,297,171 B1 3/2016 Ligman
9,316,343 B2 * 4/2016 O'Hara ..... F16M 1/04
9,404,272 B1 8/2016 Ligman
9,428,869 B2 8/2016 Pedersen
9,493,914 B2 11/2016 Kaiser
9,708,780 B1 7/2017 Ligman
9,909,267 B1 3/2018 Ligman
10,233,658 B1 * 3/2019 Ligman ..... E04F 21/241
10,494,776 B2 12/2019 Pietila
10,794,016 B2 * 10/2020 McKinnon ..... E01C 19/4893
10,914,051 B2 * 2/2021 Keigley ..... E02F 3/844
11,162,232 B2 11/2021 Ligman
2002/0015618 A1 2/2002 Quenzi et al.
2002/0127058 A1 9/2002 Quenzi et al.
2003/0161684 A1 8/2003 Quenzi et al.
2004/0009038 A1 1/2004 Roth
2004/0076472 A1 4/2004 Holmes
2004/0154237 A1 8/2004 Mainville
2005/0141963 A1 6/2005 Holmes
2005/0207843 A1 * 9/2005 Jackson ..... E04F 21/244 404/118
2005/0263302 A1 12/2005 Newnam
2006/0018715 A1 * 1/2006 Halonen ..... E01C 19/187 404/118
2006/0120801 A1 6/2006 Johnson
2006/0216114 A1 9/2006 Quenzie et al.
2007/0031191 A1 2/2007 Quenzie et al.
2007/0116520 A1 5/2007 Quenzi et al.
2007/0127985 A1 * 6/2007 Halonen ..... E01C 19/187 404/84.1
2007/0140792 A1 6/2007 Quenzie et al.
2007/0154260 A1 7/2007 Lindley
2008/0253221 A1 10/2008 Lindley
2010/0183369 A1 7/2010 Lindley
2010/0215433 A1 8/2010 Fritz
2010/0266339 A1 10/2010 Guntert
2010/0296868 A1 * 11/2010 Braun ..... B60K 6/485 404/118
2011/0236129 A1 9/2011 Guntert
2011/0266774 A1 11/2011 Gregg
2012/0183350 A1 7/2012 Mittleman
2013/0294834 A1 11/2013 Pai
2014/0169881 A1 6/2014 Hagen

(56) References Cited

U.S. PATENT DOCUMENTS

| | | | | |
|---|---|---|---|---|
| 2014/0331632 | A1 | 11/2014 | Schots | |
| 2014/0363232 | A1 | 12/2014 | Pietila | |
| 2015/0093193 | A1 | 4/2015 | Zimmermann | |
| 2015/0367388 | A1 | 12/2015 | Wang | |
| 2016/0177519 | A1* | 6/2016 | Fritz | E01C 19/22 404/84.5 |
| 2016/0245917 | A1 | 8/2016 | Schoonmaker | |
| 2017/0218576 | A1 | 8/2017 | Lindley | |
| 2017/0218577 | A1 | 8/2017 | Lindley | |
| 2020/0109525 | A1 | 4/2020 | Ligman | |
| 2020/0109526 | A1 | 4/2020 | Ligman | |
| 2020/0109573 | A1 | 4/2020 | Ligman | |
| 2020/0346254 | A1 | 11/2020 | Opatril | |

FOREIGN PATENT DOCUMENTS

| | | |
|---|---|---|
| WO | 2020076468 | 4/2020 |
| WO | 2020076469 | 4/2020 |
| WO | 2020076470 | 4/2020 |

OTHER PUBLICATIONS

European Patent Office; International Search Report and Written Opinion for PCT App. No. PCT/US2019/051695 dated Nov. 7, 2019.

European Patent Office; International Search Report and Written Opinion for PCT App. No. PCT/US2019/051698 dated Nov. 7, 2019.

Australian National Stage App. No. 2019357862 entered national stage on May 6, 2021 titled Apparatus for Screeding Concrete.

Australian National Stage App. No. 2019359107 entered national stage on May 6, 2021 titled Drive System for Screeding Concrete.

Australian National Stage App. No. 2019358780 entered national stage on May 6, 2021 titled Electronically Actuated Leveling System for Screeding Concrete.

European National Stage App. No. 19780088.1 entered national stage on Apr. 28, 2021 titled Apparatus for Screeding Concrete.

European National Stage App. No. 19779704.6 entered national stage on Apr. 28, 2021 titled Drive System for Screeding Concrete.

European National Stage App. No. 19779340.9 entered national stage on Apr. 28, 2021 titled Electronically Actuated Leveling System for Screeding Concrete.

European Patent Office Communication in app. No. 19780088.1 dated Jul. 21, 2021.

European Patent Office Communication in app. No. 19779704.6 dated Jul. 21, 2021.

European Patent Office Communication in app. No. 19779340.9 dated Jul. 21, 2021.

* cited by examiner

APPARATUS FOR SCREEDING CONCRETE

BACKGROUND OF THE INVENTION

Field of the Invention

The present invention relates generally to a system and apparatus for leveling and finishing or "screeding" concrete and more specifically to a lightweight concrete screeding apparatus for screeding a poured concrete surface. The system and apparatus provides a light, portable, and maneuverable screed that is readily moved around a poured concrete surface that is being finished and is particularly useful for interior concrete pours in high rise structures or multi-level buildings that are commonly termed "upper deck pours". The screeding apparatus may be operated as a "drive-in" machine that is driven into a poured surface and thence retracted to screed the surface and may be alternatively provided with a screed head that includes any one or more of an adjustable plow, a finish blade and/or a plurality of augers for providing a finished surface to concrete pours.

Description of the Related Art

In construction settings when liquid concrete is poured to produce a surface it must be quickly and carefully smoothed or screeded, so that when the concrete sets and hardens it produces an even, level surface. Since this poured concrete surface is almost always a foundation for additional construction, machine base applications, or for vertical storage such as warehousing and shelving space, it is highly desirable to produce a surface that is consistently level over its entire area. In large poured areas it is unwieldy and labor intensive to manually level and smooth a poured concrete surface as well as extremely difficult to maintain a consistent finished grade.

In order to aid in the screeding of relatively large surface area concrete pours, a variety of concrete screeding or troweling machines have been accepted into use in the art. These machines typically include a screed head comprising a flat troweling surface for contacting the poured concrete that is mechanically extended and retracted across the concrete surface to produce a smooth surface finish. Many of these prior art devices include various systems for leveling the screed head relative to a reference plane such that the finished surface is relatively flat once it is screeded.

Prior art screeding devices often comprise a frame having a centrally mounted turret from which a boom is extended. Turret type screeders provide for some maneuverability since the turrets are capable of rotation via a driven gear or similar mechanism. However, these screeding systems are typically quite complex, heavy and costly due to the need for complicated mechanical and electrical controls to rotate the turret and extend the boom, not to mention the power required to position a turret. In fact, while many prior art screeding devices are available, a great deal of concrete screeding is still accomplished by hand due to the size and cost of automated screeders.

A subset of prior art screeding machines are manufactured to be relatively small in size to screed smaller concrete pours or to screed pours in areas where access and maneuverability are at a premium. Many of these screeds are of the "drive-in" type, wherein the screed is self-powered and is actually driven into the concrete pour so that the finish blade and/or screed head is then slowly dragged across the surface being finished. These prior art drive-in type machines are often smaller versions of larger concrete screeds, and may have a leveling system that moves the screed head upwardly and downwardly during the screed pass to provide a relatively level finished surface. Drive-in screeds are frequently used in "upper deck" pours, where floors are being poured in multi-level buildings. As such, maneuverability is paramount since the machines are often required to screed around support columns, HVAC ducting, and plumbing and electrical chases.

These drive-in screeds are often simply smaller versions of conventional screeds, and often suffer from a variety of disadvantages as a result; a lack of maneuverability, difficulty in providing consistent leveling along the length of the screed head, and relatively high weight. The weight of the screed can be quite limiting, particularly where the floor supporting the concrete may flex or even collapse under the weight of the concrete and the screed being moved across it. This problem may result in uneven finished surfaces.

Many of these prior art machines, being designed to operate on large concrete pours such as parking lots or single floor building construction projects, can be quite difficult to use in upper deck concrete pours primarily due to their weight and lack of maneuverability. As a result, some screed machines have been built that are simply manually pulled vibrating finishing blades. These machines typically don't plow or level concrete, but are primarily motorized, vibrating finish blades capable of being operated by hand to smooth—but not level—a smaller poured surface.

Of course these smaller hand operated concrete finishing machines require a great deal of hand leveling of the concrete pour, since they are unable to reposition the concrete material being poured. As a result they have limited usefulness where a great deal of concrete must be poured and leveled, for example in upper deck pours.

Finally, one additional difficulty with prior art screed systems used in upper deck or building interior pours is the emission of pollutants from the internal combustion engines (gasoline or diesel) required to provide power to the screed. In enclosed areas the exhaust must commonly be removed from the environment in order to comply with various governmental safety regulations and provide a safe and healthy working environment for operators and others working in the area. Of course ducting or removing machine exhaust is time consuming and expensive.

Accordingly, there is a need in the art for a system and method screeding and troweling concrete that provides a consistently level finished surface with a minimum of mechanical and electrical system complexity, light weight, and the ability to quickly maneuver a screed in enclosed spaces during a pour, and offering reduced or zero emissions Other features, objects and advantages of the present invention will become apparent from the detailed description of the drawing Figures taken in conjunction with the appended drawing Figures.

SUMMARY OF THE INVENTION

The present disclosure is related to systems and apparatus for screeding a poured concrete surface. The system and apparatus described herein utilizes a lightweight frame mounted on a maneuverable drive assembly for quickly positioning and operating the apparatus to screed poured concrete. Additionally, the system and apparatus provides an accurate leveling system that quickly and continuously levels the entire apparatus from side-to-side and front-to-back, utilizing a control system and associated leveling sensors.

In various embodiments and accordance with some aspects of the invention, the system disclosed herein provides a lightweight frame assembly having a screed head secured to one end thereof for contacting and smoothing a poured concrete surface. The frame assembly provides support for a power system such as an internal combustion engine or a battery system that powers operation of the screed and its attendant components. In some embodiments a hydraulic system is provided to a leveling system to provide a smooth finished surface. In some other embodiments the leveling system is electromechanical so that the screed can be constructed without a hydraulic system and its attendant weight.

In some embodiments the system and apparatus disclosed herein provides a drive system having a plurality of driven or powered wheels that may be driven either in concert with one another or independently depending upon an operator's commands supplied through a user input and/or a steering assembly. In other embodiments, the drive system and methods disclosed herein may include a plurality of electronically or hydraulically powered driven wheels enables the screed apparatus to perform zero-radius turns as well as move completely parallel to a concrete pour. Additionally, and in some aspects of the invention the drive system may be controlled through a user interface, for example a joystick, track pad, touch screen, pushbuttons, or a smart device such as a phone or tablet, either remotely or on board the screeding apparatus.

In other embodiments and aspects the system and apparatus includes a steering system that provides a mechanical linkage between a plurality of wheels supporting the screed, and a single steering handle that permits an operator or user to drive the screed by a simple movement of the steering handle. In other aspects the steering of the screed may be accomplished entirely through an operator interface, either remotely or on board the screed.

As used herein for purposes of the present disclosure, the term "screed apparatus" should be understood to be generally synonymous with and include any device that is capable of operating on and smoothing an uncured concrete surface. The system and apparatus referred to herein may be powered by internal combustion systems or electrical systems, and may include a plurality of electrical, electromechanical and hydraulically operated components and sensors the components operable by and responsive to manipulation of control knobs, selectors, or operator interfaces.

The term "screed head" is used herein generally to describe a member or members for contacting and smoothing and uncured concrete surface and may include one or more of a strike-off plow, an auger, a roller, and a vibrating member. Accordingly, the term screed head is not limited to one specific apparatus or structure, but is intended to encompass all structures that may be used to smooth and/or level a poured concrete surface.

The term "leveling assembly" is used herein to generally describe a plurality of leveling legs on which the screed apparatus is supported and a plurality of actuators responsive to a plurality of sensors for adjusting the elevation of the screed with respect to a reference plane. The number and type of leveling legs and the number and type of sensors for determining elevation, slope and/or tilt of the screed is not limited to a specific apparatus, structure, or sensor configuration, but rather is intended to include all structures, systems and sensors equivalent to those specific examples and embodiments disclosed herein.

The term "drive assembly" is used herein to refer to a plurality of powered wheels that are capable of turning and being driven in forward in reverse by a plurality of drive components. It is contemplated that a wide variety of drive mechanisms may be employed in the environment of the invention to perform the functions of the drive system specified herein without departing from the scope of the invention.

The term "controller" or "processor" is used herein generally to describe various apparatus relating to the operation of the system and the appliances referred to herein. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), programmable logic controllers (PLCs), and field-programmable gate arrays (FPGAs).

A processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "Internet" or synonymously "Internet of things" refers to the global computer network providing a variety of information and communication facilities, consisting of interconnected networks using standardized communication protocols. The appliances, controllers and processors referred may be operatively connected to the Internet.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWING FIGURES

In the drawings, like reference characters generally refer to the same parts throughout the different views. Also, the drawings are not necessarily to scale, emphasis instead generally being placed upon illustrating the principles of the invention.

DETAILED DESCRIPTION OF THE PREFERRED EMBODIMENT(S)

Figure 1:
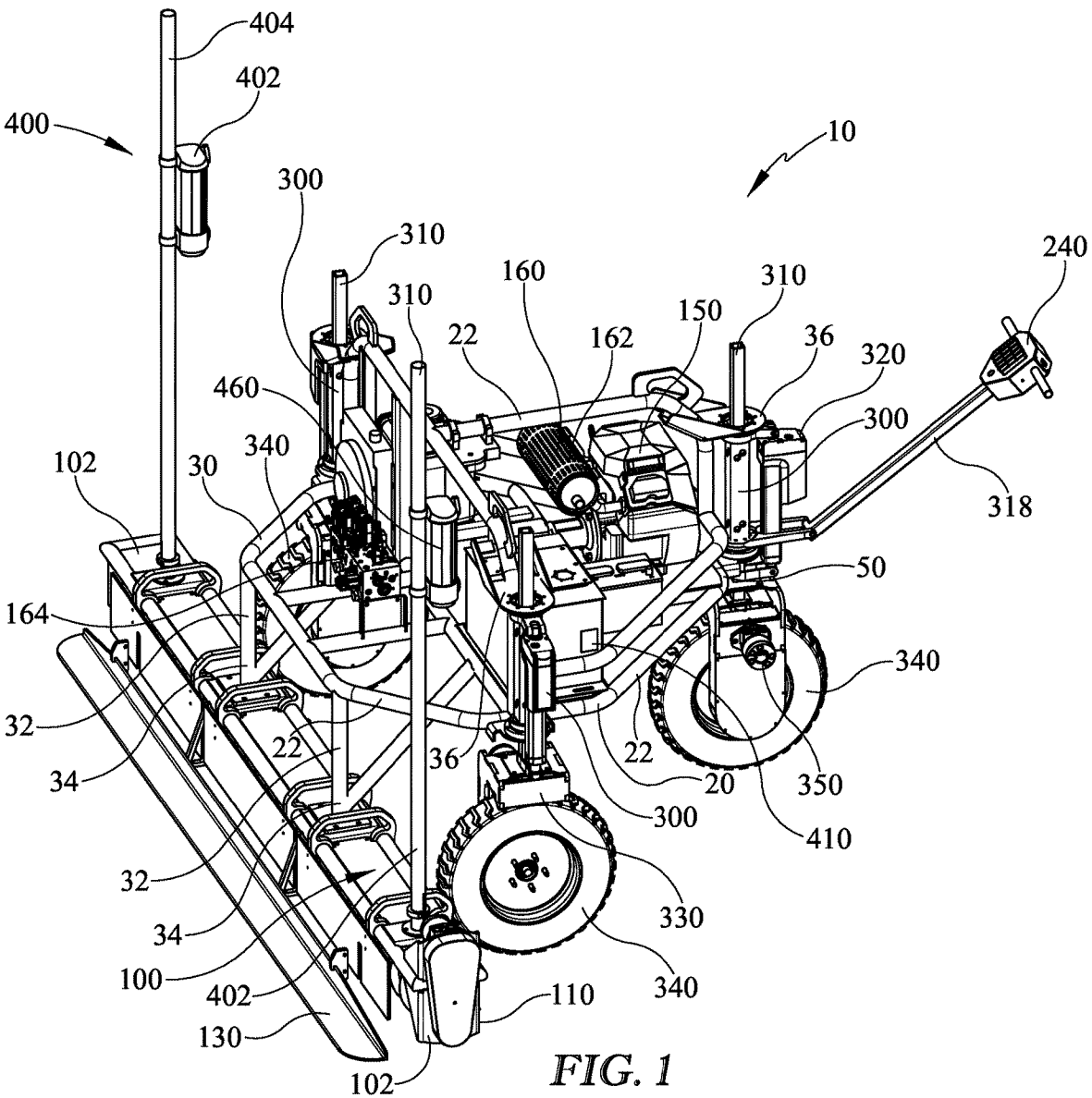
FIG. 1 is a perspective view of a concrete screed in accordance with one embodiment of the present invention.
Figure 2:
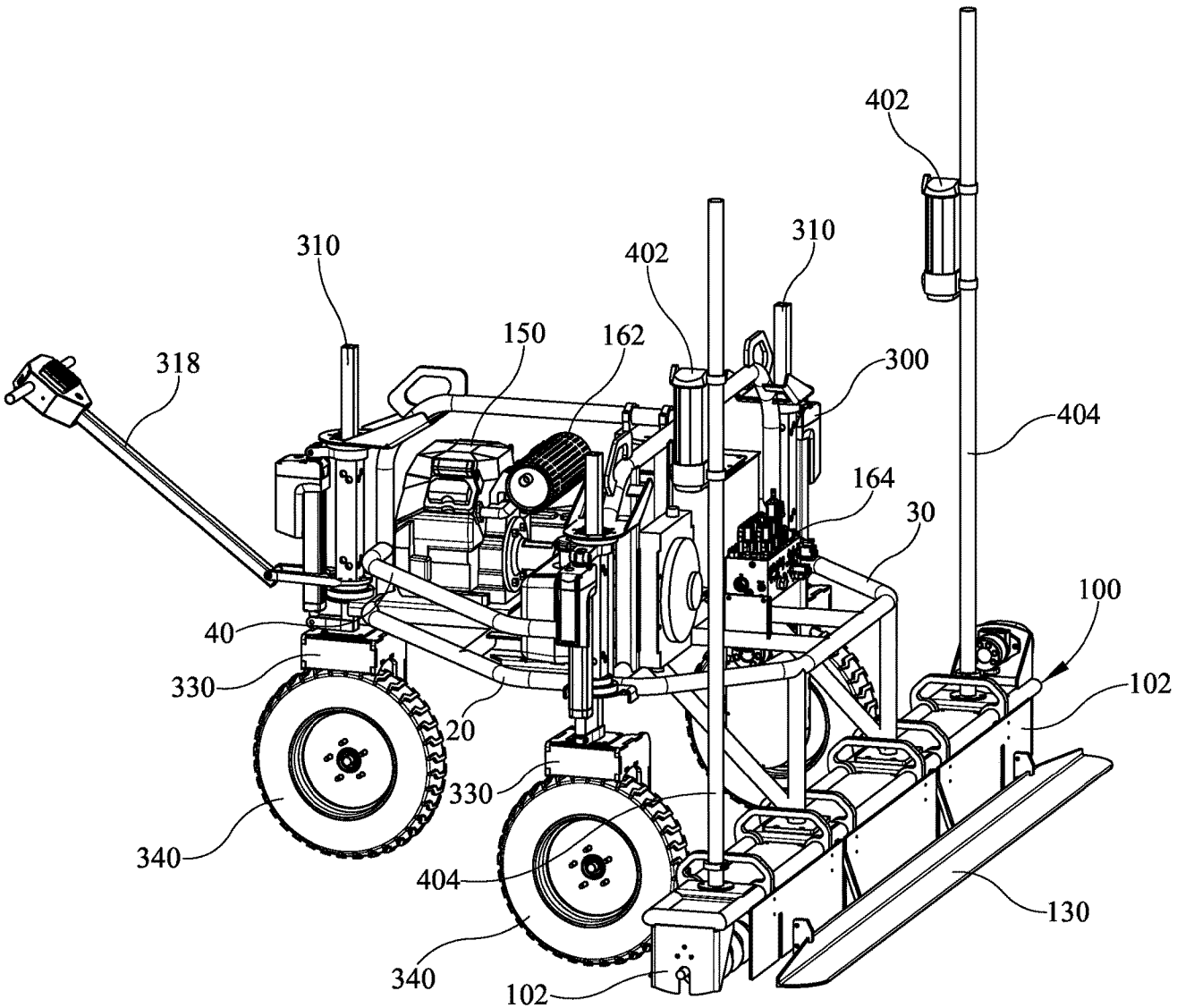
FIG. 2 is a perspective view of a concrete screed in accordance with one embodiment of the present invention.
Figure 3:
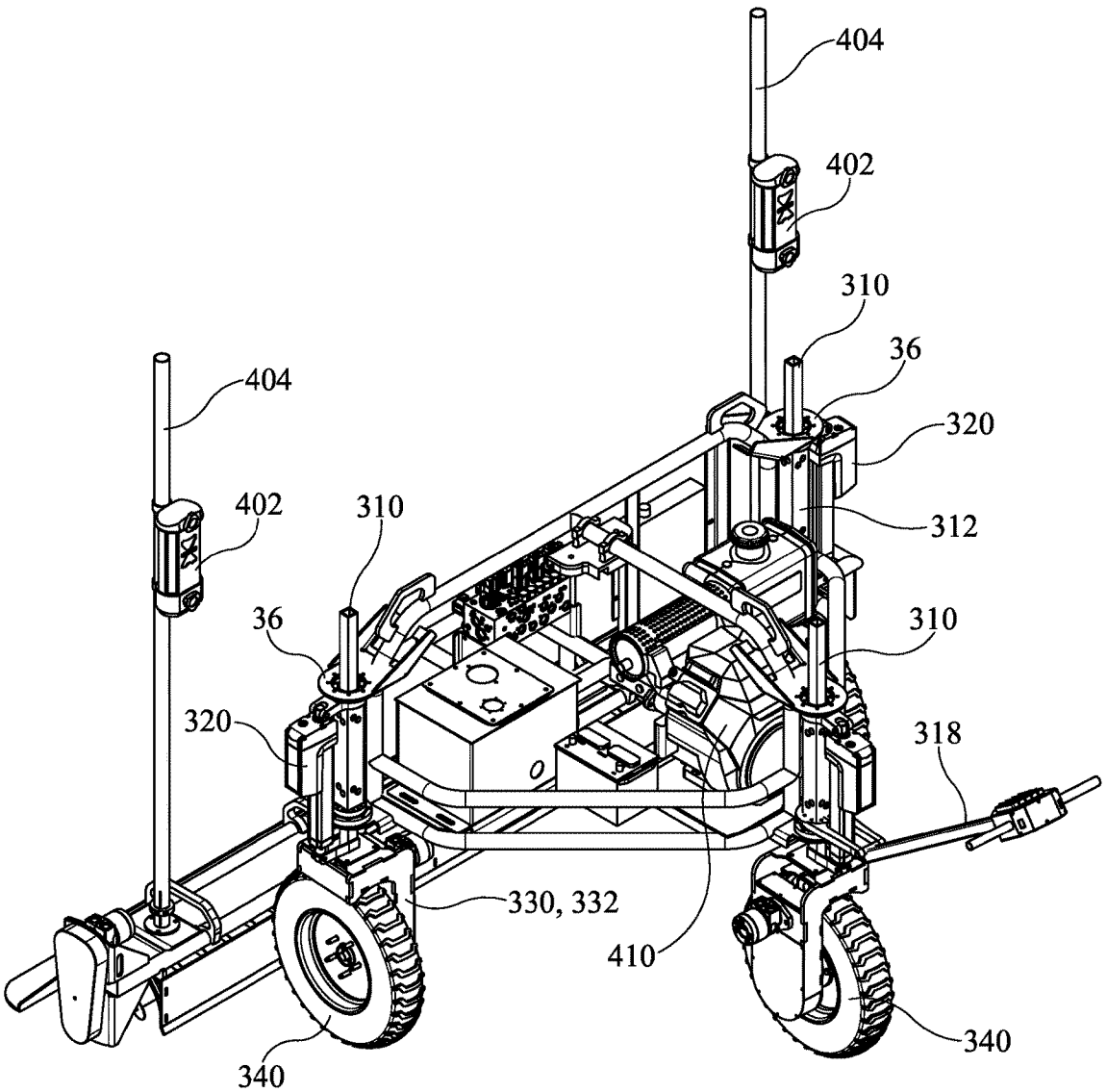
FIG. 3 is a perspective view of a concrete screed in accordance with one embodiment of the present invention.
Figure 4:
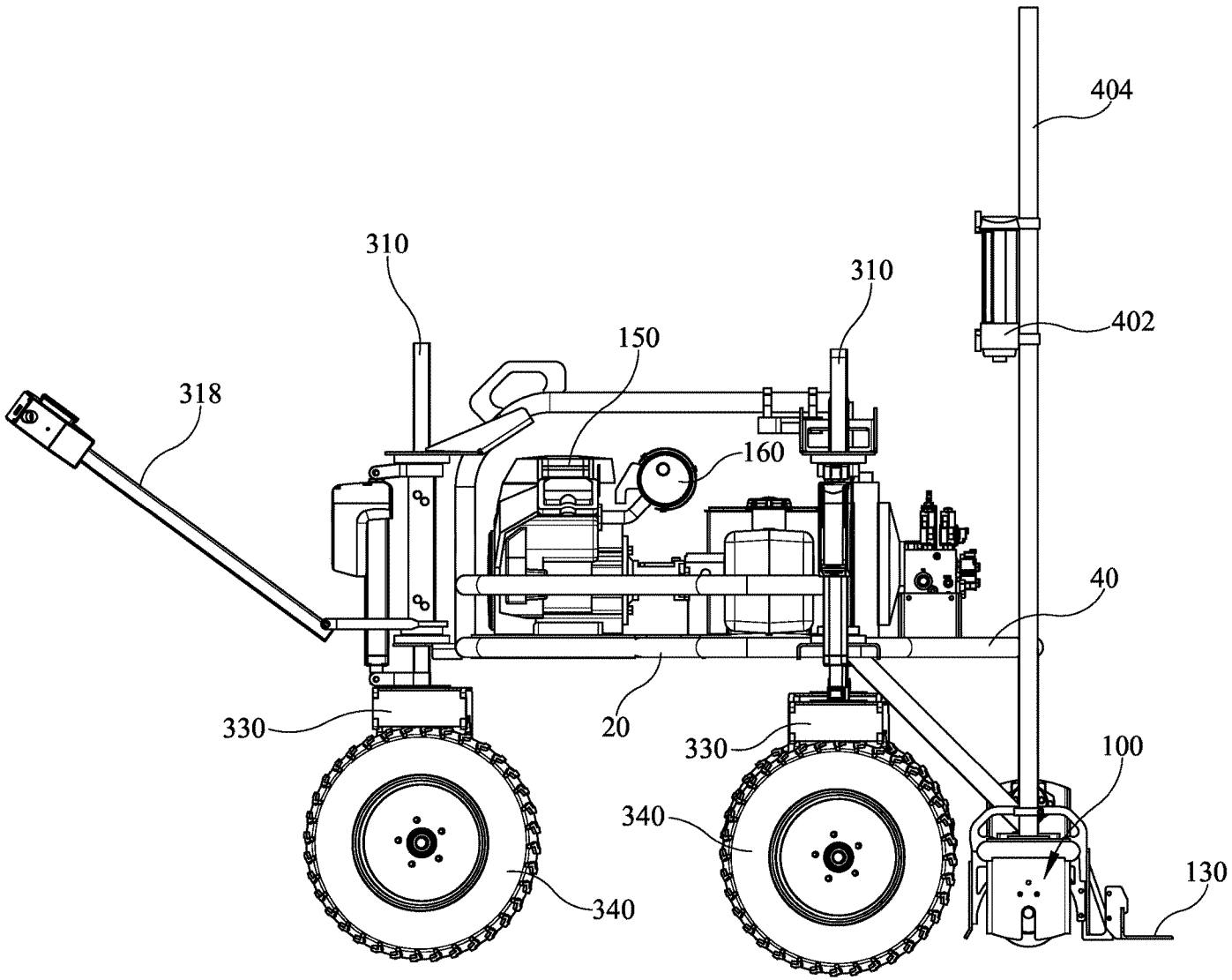
FIG. 4 is a side view of a concrete screed in accordance with one embodiment of the present invention.
Figure 5:
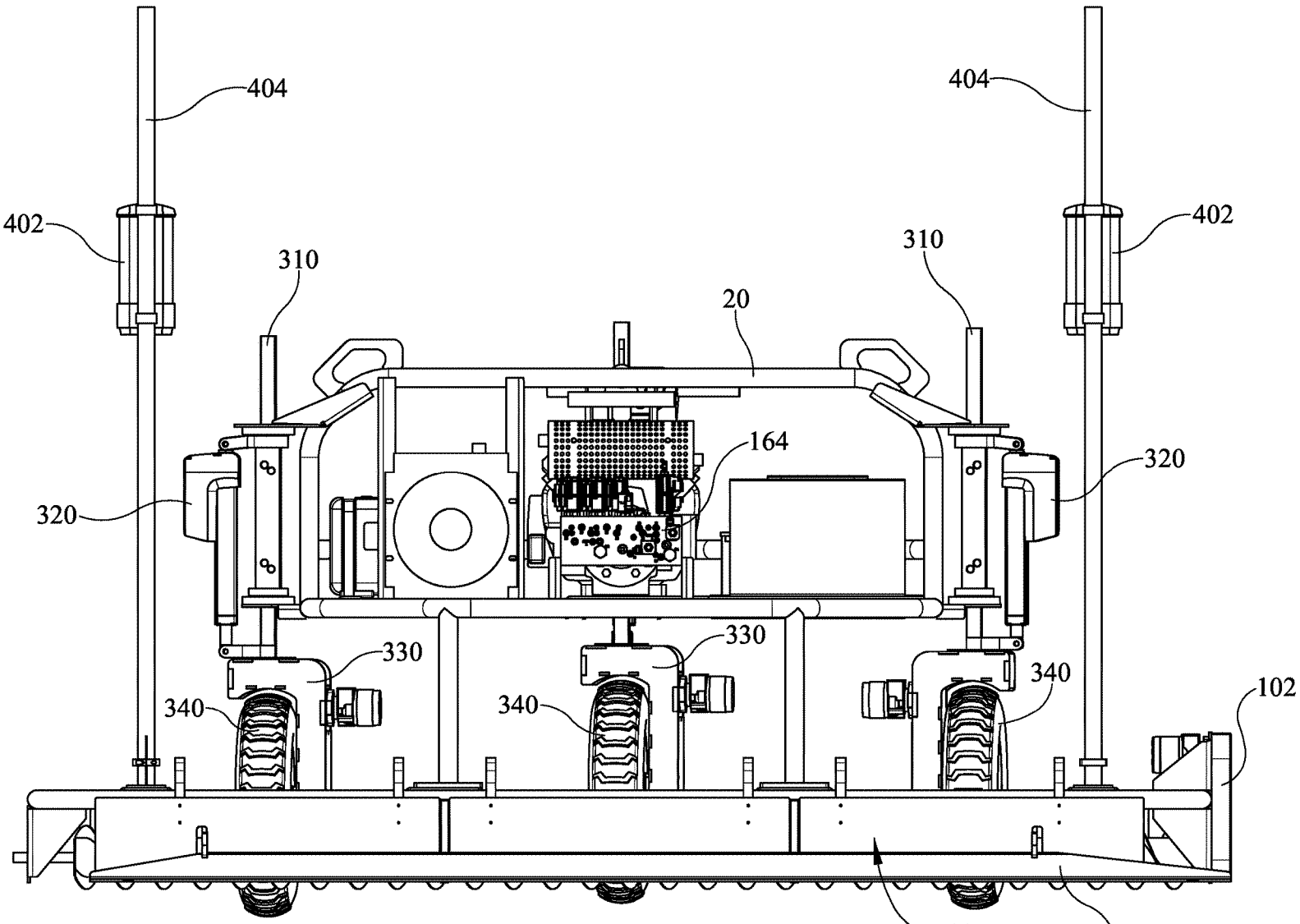
FIG. 5 is a front view of a concrete screed in accordance with one embodiment of the present invention.
Figure 6:
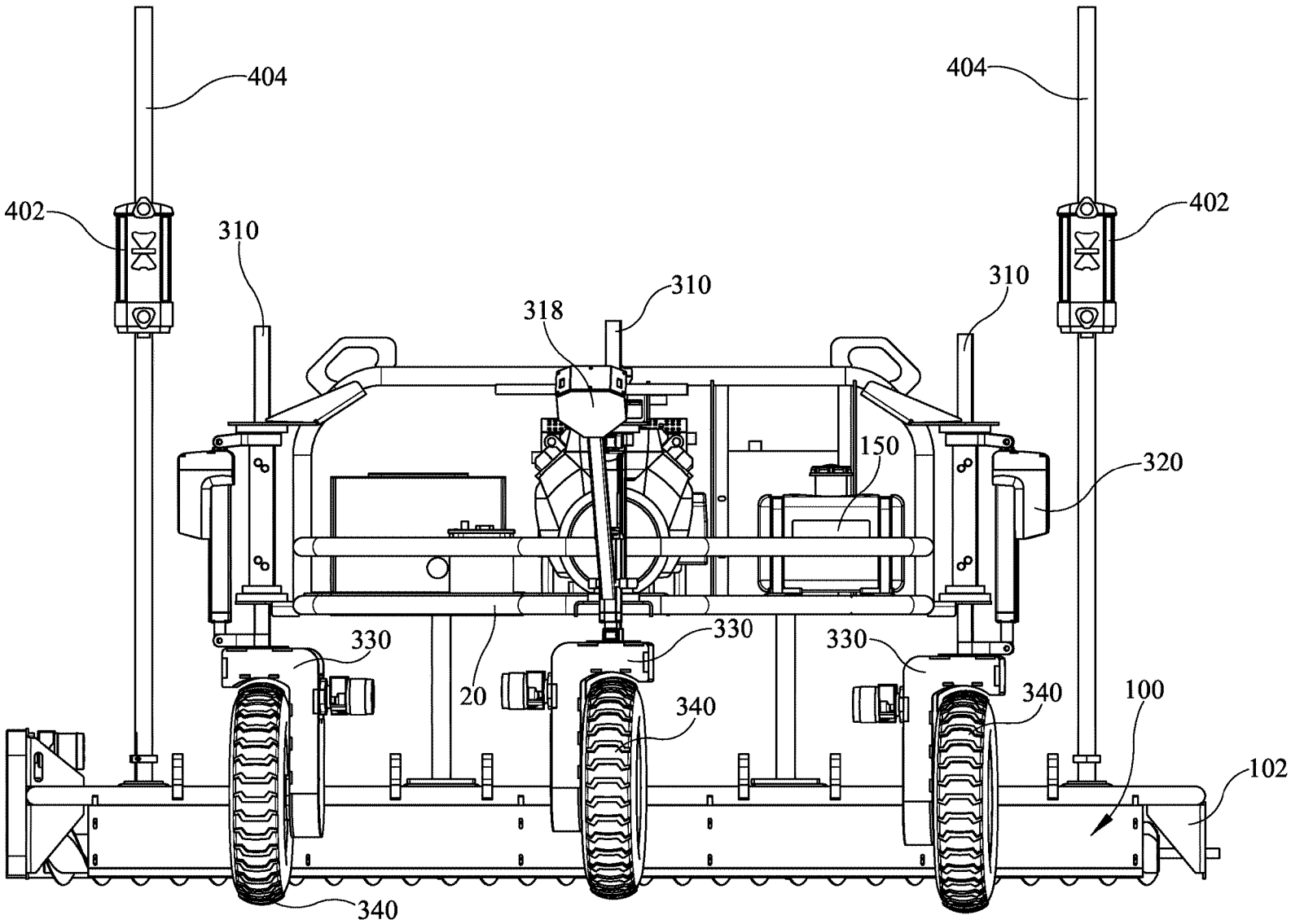
FIG. 6 is a rear view of a concrete screed in accordance with one embodiment of the present invention.
Figure 7:
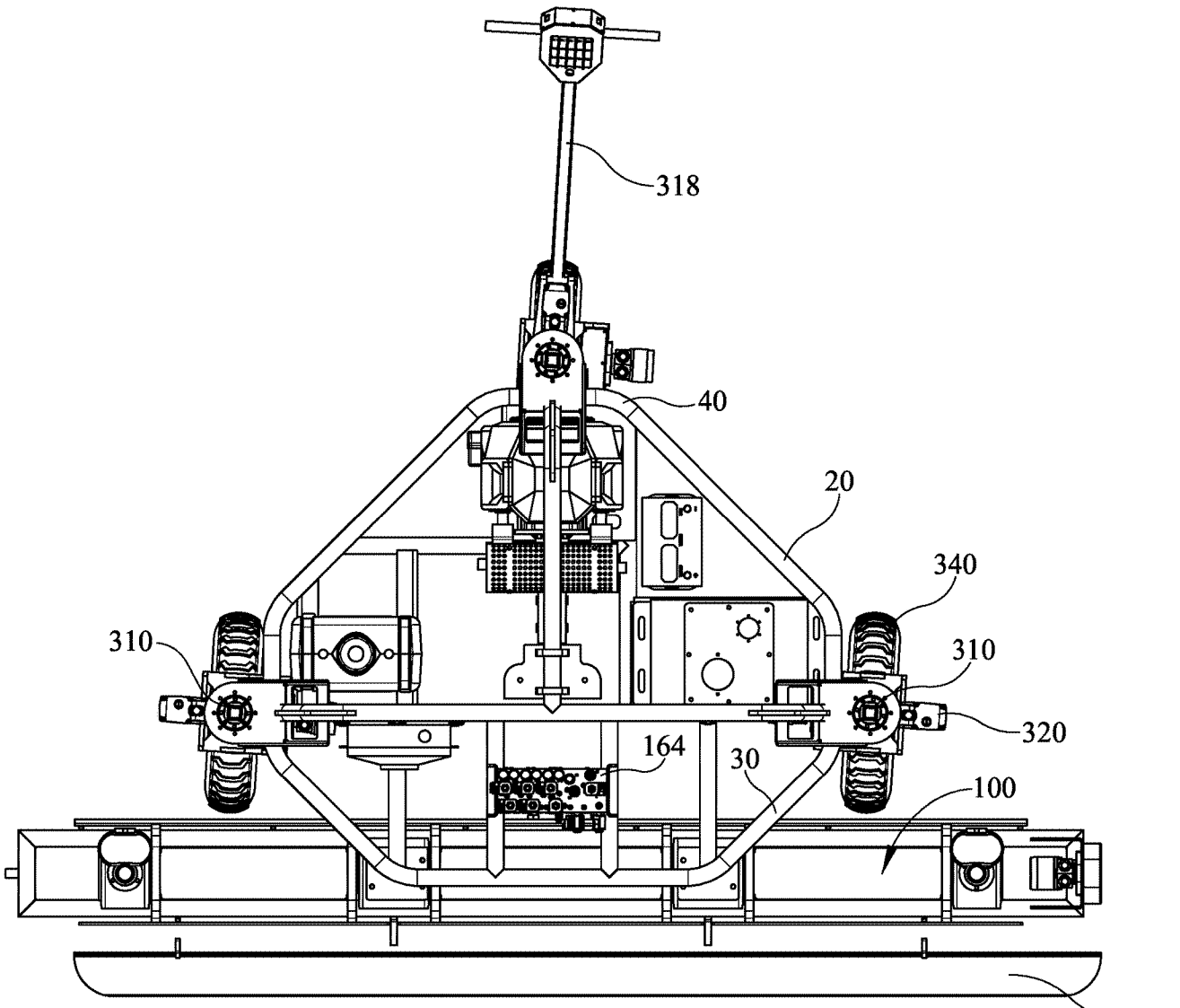
FIG. 7 is a top view of a concrete screed in accordance with one embodiment of the present invention.
Figure 8:
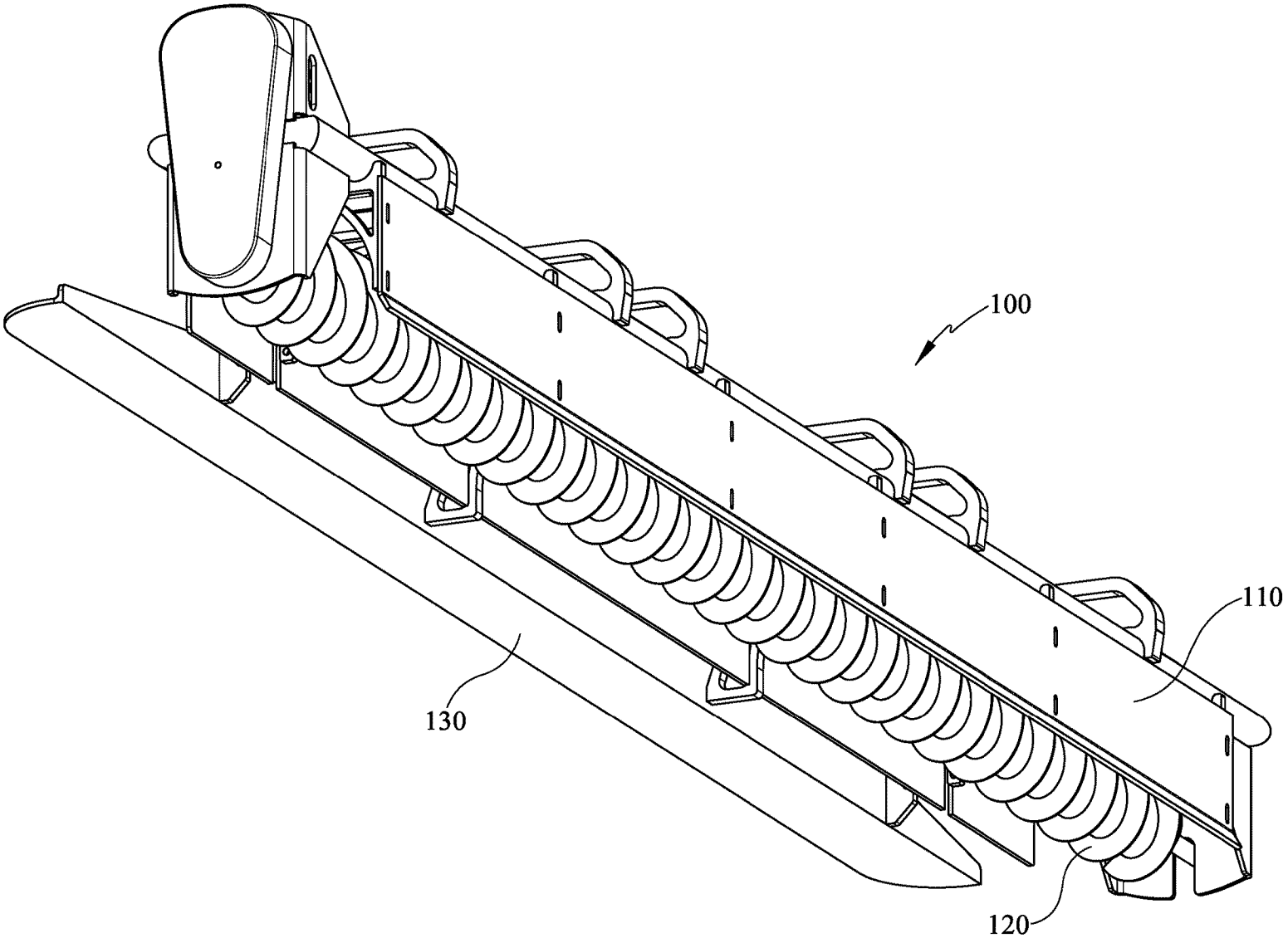
FIG. 8 is a perspective view of a screed head in accordance with one embodiment of the present invention.
Figure 9:
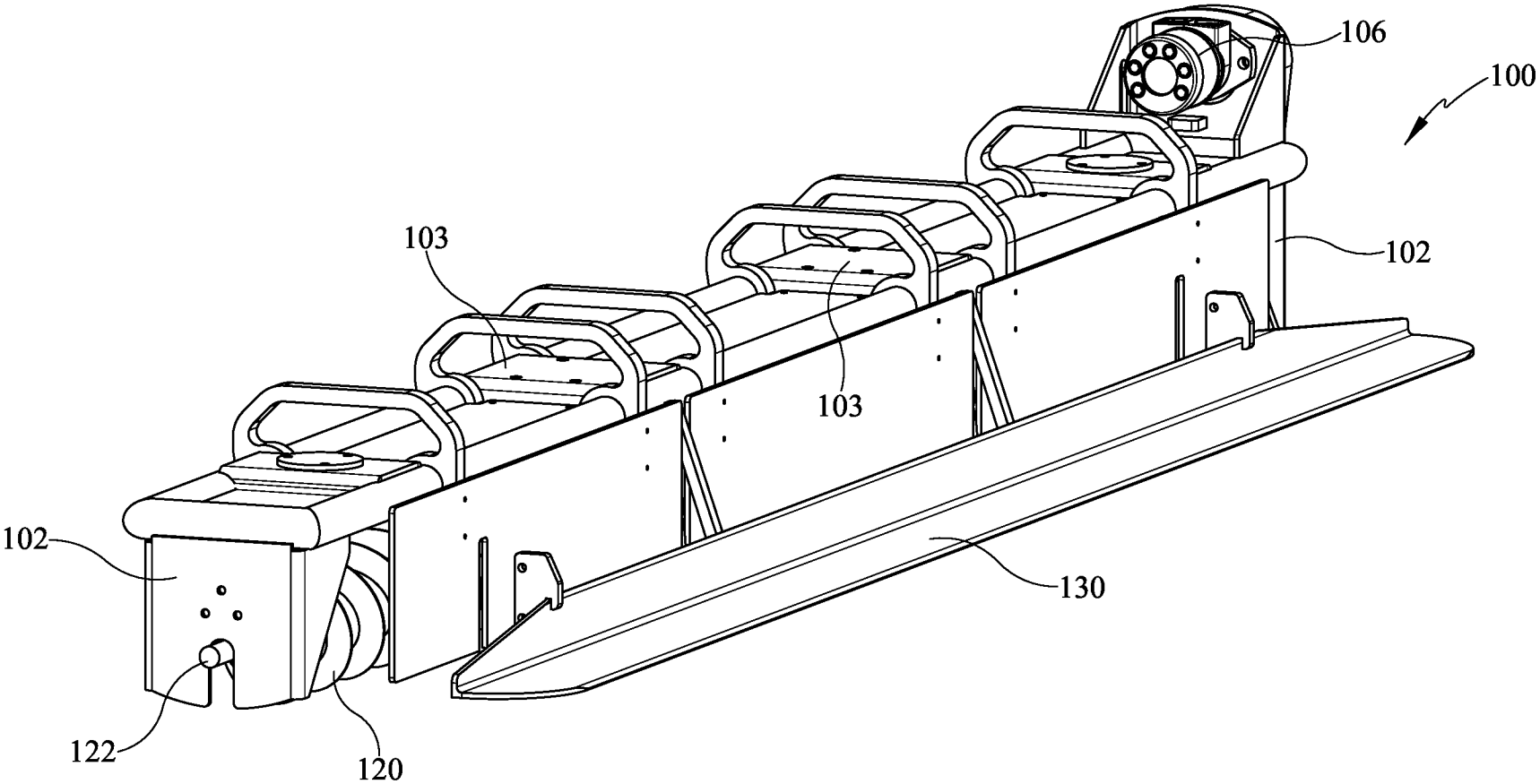
FIG. 9 is a perspective view of a screed head in accordance with one embodiment of the present invention.
Figure 10:
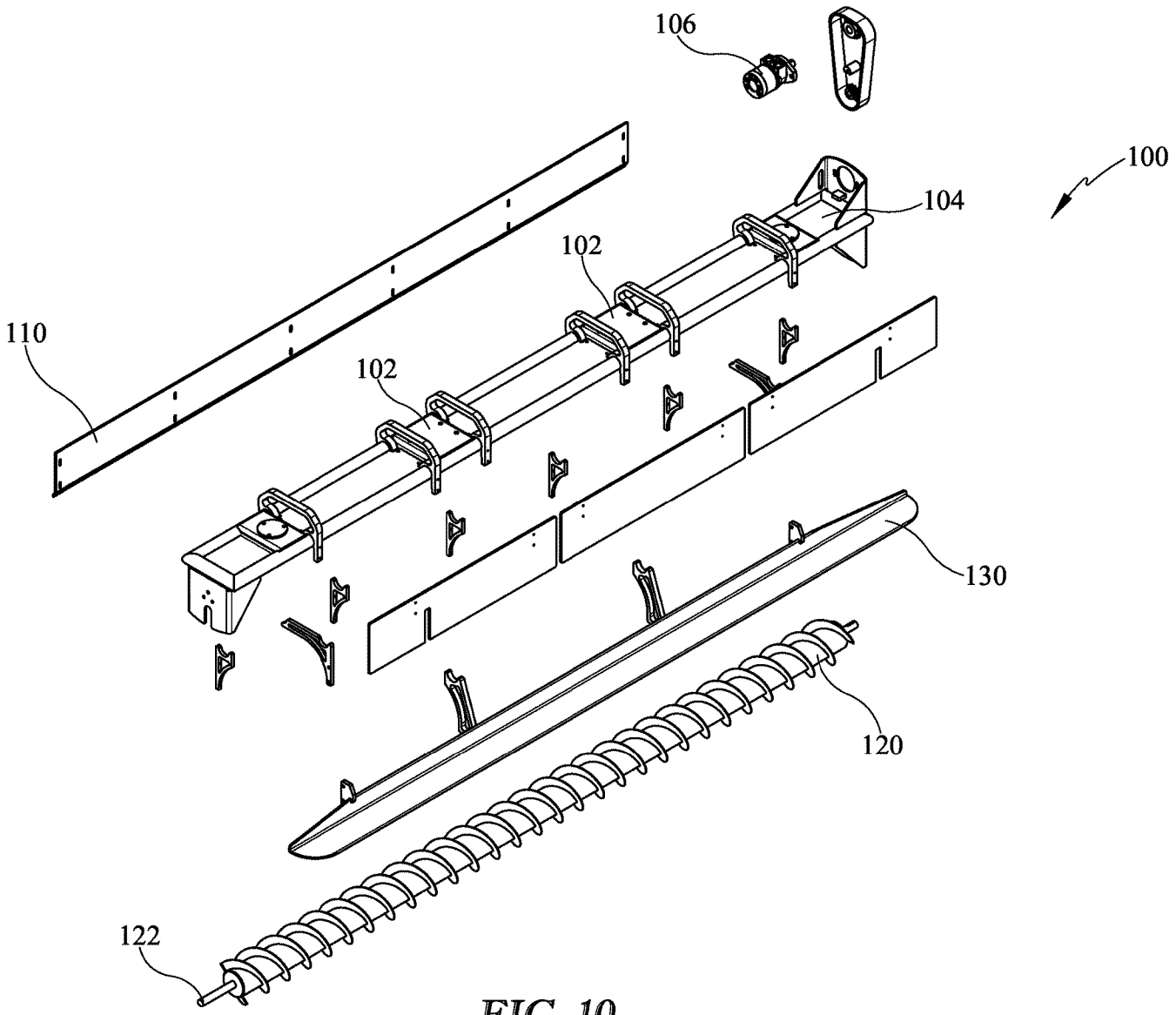
FIG. 10 is an exploded perspective view of a screed head in accordance with one embodiment of the present invention.

Numerous variations and modifications will be apparent to one of ordinary skill in the art, as will become apparent from the description below. Therefore, the invention is not limited to the specific implementations discussed herein.

Referring now to drawing FIGS. 1-7, and in accordance with some aspects and embodiments of the invention, the system and apparatus 10 described herein overcomes the aforementioned inherent problems in the prior art by providing a concrete screed system and apparatus 10, known in the art as a "concrete screed" or simply a "screed", that comprises a frame assembly 20 that supports and secures the various components and subsystems of apparatus 10. Frame assembly 20 includes a front frame 30 and a rear frame 40 that includes a plurality of members 22 securely fastened together to provide a generally rigid frame assembly 20 that is capable of supporting apparatus 10 with minimal flexing. Frame assembly 20 may be formed of various materials including but not limited to aluminum, iron, steel and various alloys thereof, carbon fiber and even rigid polymers without departing from the scope of the invention.

As shown best in FIGS. 1-7, 12 and 13, for example, front frame 30 may include a plurality of front tubes 32 extending therefrom on which a plurality of screed head mounts 34 are provided, for mounting a screed head assembly 100 thereto as described further herein below. As depicted in the drawings, front frame 30, tubes 32 and mounts 34 may be positioned such that screed head assembly 100 is secured generally parallel to and forward of frame 20 front 30. Frame 30 further includes a plurality of spaced leveling assembly mounts 36 that engage a leveling assembly 400, as detailed herein below. While frame 20 is depicted in the drawing Figures as generally polygonal in shape and including a plurality of connected members, one of ordinary skill in the art will recognize that frame 20 may have a variety of configurations and shapes to support and secure the various components of screed apparatus 10 without departing from the scope of the present invention.

Referring now to FIGS. 1-10 in accordance with some aspects of the invention a screed head assembly 100 is provided with opposed ends 102 and a mounting plate or portion 103 secured to a screed head body 104. Screed head assembly 100 mounting plate 103 is rigidly fastened or secured to screed head mounts 34 of frame 30 by any known fastening method. Screed head assembly 100 may in certain embodiments include a drive motor 106, for example a hydraulic motor secured to screed head body 104, and at least one of a plow 110, an auger or augers 120 journaled for rotation around a central axis 122, a finish blade 130 for smoothing poured concrete, and in some aspects and embodiments, a roller or rollers. Drive motor 106 is used to rotate auger 120 during a screeding pass. In some embodiments screed head assembly 100 may include only one finish blade 130, or only one or two augers 120, a roller or rollers, or any combination of these concrete finishing members without departing from the scope of the invention. Furthermore, screed head assembly 100, plow 110, auger 120, finish blade 130, and roller can be constructed of a lightweight material such as aluminum to reduce the overall weight of screed head assembly 100.

In some aspects and embodiments the system and apparatus 10 described herein may also comprise a power system, for example an internal combustion engine 150, or an electrical power source 150 such as a battery system or a generator system. In some aspects and embodiments the power system 150 may include an output shaft coupled to a hydraulic assembly 160, for supplying pressurized hydraulic fluid to a plurality of components necessary to operate screed apparatus 10 via a plurality of electrically actuated control valves. Hydraulic assembly 160 may comprise a conventional hydraulic pump 162, manifold 164, and associated control valves for supplying pressurized fluid to various components of screed apparatus 10. In yet further aspects the power system 150 may be entirely electric, for example a rechargeable battery or batteries, or an electric motor or generator, requiring no hydraulic system 160, and thereby further reducing the weight and emission pollutants of screed apparatus 10. In these embodiments all components of screed apparatus 10 are electric or electromechanical, and are thus driven by a battery 150 or generator 150 as necessary.

In some aspects and embodiments of the present invention, concrete screed apparatus 10 power source 150 may be mounted directly on screed head assembly 100, thereby reducing the weight of screed apparatus 10 compared to conventional two part frame mounted machines. Additionally, optional hydraulic system 160 may also be mounted to or directly over screed head assembly 100. These embodiments also enable the relatively even distribution of screed apparatus 10 weight across the frame assembly 40, thereby providing for easier leveling of apparatus 10 and more even finished surfaces. Furthermore, the weight provided by an integral hydraulic system 160 improves the ability of apparatus 10 to level and smooth the finished surface.

Figure 11:
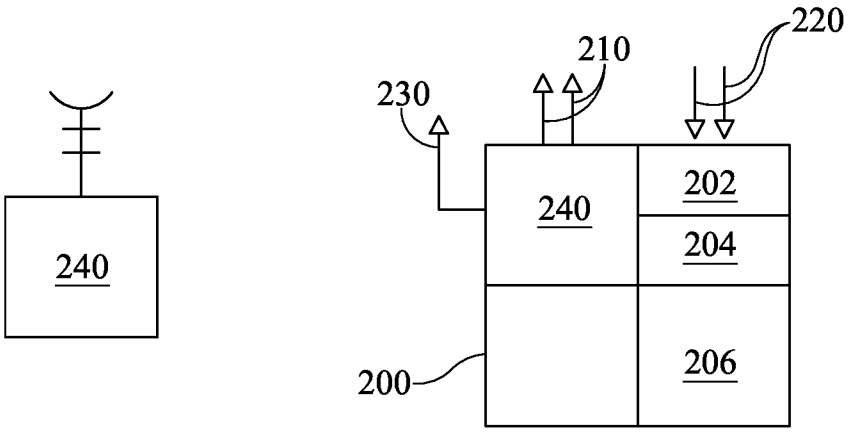
FIG. 11 is a block diagram of a control system in accordance with one embodiment of the invention.

In some embodiments, and as depicted in FIG. 11, system and apparatus 10 may further comprise a controller 200 which may a processor or processors 202 and memory 204. System 10 controller 200 may further comprise a plurality of signal outputs 210 and signal inputs 220 that may be operatively connected to a plurality of system 10 components to monitor and direct system 10 operation. Furthermore, in some embodiments controller 200 may include a wireless or hard-wired communications interface 230 that enables controller 200 to communicate with external devices or communications networks such as the internet, that may be integrated into system 10. Furthermore, inputs 220 and outputs 210 may be operatively coupled to, for example, a plurality of electrically actuated valves to operate hydraulic system 160 and other components as discussed further herein below. Throughout the specification the operation of hydraulic cylinders will be understood to be effected through the use of a hydraulic system 160, comprising electrically actuated hydraulic valves and a controller 200 for operating said valves, as is—known to one of ordinary skill in the art.

Additionally, controller 200 may be equipped with an operator or user interface 240 to provide audible or visual feedback to a user as well as provide a user the ability to provide instructions or commands to controller 200. Exemplary but non-limiting user interfaces that may be employed include a mouse, keypads, touch-screens, keyboards, switches, joysticks and/or touch pads. Any user interface 240 may be employed for use in the invention without departing from the scope thereof. Furthermore, user interface 240 wirelessly communicate with controller 200 such that it may be remotely located from screed apparatus 10. It will be understood that FIG. 11 constitutes, in some respects, an abstraction and that the actual organization of the components of apparatus 10 and controller 200 may be more complex than illustrated.

The processor 202 may be any hardware device capable of executing instructions stored in memory 204 or data storage 206 or otherwise processing data. As such, the processor may include a microprocessor, field programmable gate array (FPGA), application-specific integrated circuit (ASIC), or other similar devices.

The memory 204 may include various memories such as, for example L1, L2, or L3 cache or system memory. As such, the memory 204 may include static random access memory (SRAM), dynamic RAM (DRAM), flash memory, read only memory (ROM), or other similar memory devices. It will be apparent that, in embodiments where the processor includes one or more ASICs (or other processing devices) that implement one or more of the functions described herein in hardware, the software described as corresponding to such functionality in other embodiments may be omitted.

The user interface 240 may include one or more devices for enabling communication with a user such as an administrator. For example, the user interface 240 may include a display, a mouse, and a keyboard for receiving user commands, or a joystick or similar device for directing apparatus operations. In some embodiments, the user interface 240 may include a command line interface or graphical user interface that may be presented to a remote terminal via the communication interface 230.

The communication interface 230 may include one or more devices for enabling communication with other hardware devices. For example, the communication interface 230 may include a network interface card (NIC) configured to communicate according to the Ethernet protocol. Additionally, the communication interface 230 may implement a TCP/IP stack for communication according to the TCP/IP protocols. Various alternative or additional hardware or configurations for the communication interface 230 will be apparent.

The storage 206 may include one or more machine-readable storage media such as read-only memory (ROM), random-access memory (RAM), magnetic disk storage media, optical storage media, flash-memory devices, or similar storage media. In various embodiments, the storage 206 may store instructions for execution by the processor 202 or data upon which the processor 202 may operate. For example, the storage 206 may store a base operating system for controlling various basic operations of the hardware. Other instruction sets may also be stored in storage 206 for executing various functions of system 10, in accordance with the embodiments detailed below.

It will be apparent that various information described as stored in the storage 206 may be additionally or alternatively stored in the memory 204. In this respect, the memory 204 may also be considered to constitute a "storage device" and the storage 206 may be considered a "memory." Various other arrangements will be apparent. Further, the memory 204 and storage 206 may both be considered to be "non-transitory machine-readable media." As used herein, the term "non-transitory" will be understood to exclude transitory signals but to include all forms of storage, including both volatile and non-volatile memories.

While the controller 200 is shown as including one of each described component, the various components may be duplicated in various embodiments. For example, the processor 202 may include multiple microprocessors that are configured to independently execute the methods described herein or are configured to perform steps or subroutines of the methods described herein such that the multiple processors cooperate to achieve the functionality described herein. Further, where the controller 200 is implemented in a cloud computing system, the various hardware components may belong to separate physical systems. For example, the processor 202 may include a first processor in a first server and a second processor in a second server.

Referring again to FIGS. 1-7 and 12-21, and in some aspects and embodiments apparatus 10 further comprises a leveling system or assembly 300, that may include a plurality of vertically adjustable leveling legs 310 that are secured in a generally vertical orientation to screed head assembly 100 at leveling assembly mounts 36. In some embodiments as leveling legs 310 may comprise a vertically movable leg 310 journaled in a sleeve 312 that is secured to leveling assembly mounts 36. As shown in the drawing Figures, in one exemplary but non-limiting embodiment of the invention two opposed legs 310 are spaced apart and disposed at a front frame 30, proximate screed head assembly 100 and generally positioned at a opposed ends 102 thereof while a single leg 310 is secured to rear frame 40 of screed apparatus 10, proximate the center thereof. In this embodiment, the two vertically adjustable opposed legs 310 may be used to level the screed head 100, while the rear leg 310 may be used to adjust the tilt thereof, as will be discussed further herein below.

The screed apparatus 10 in some aspects further comprises a plurality of wheel mounts 330 secured to said leveling legs 310 at a bottom portion thereof, onto which a plurality of wheels 340 are rotatably mounted. In these aspects and embodiments of the invention, screed apparatus 10 essentially forms a "one piece" or unitary apparatus 10 whereby the entire screed 10 is leveled and moved by leveling legs 310 while screed head assembly 100 is leveling and smoothing a poured concrete surface. Wheels 340 may be comprised of a hard concrete resistant material such as rubber, and in some embodiments may comprise aluminum spindles that easily roll through the concrete being screeded, as well as being easy to clean after use.

Figure 12:
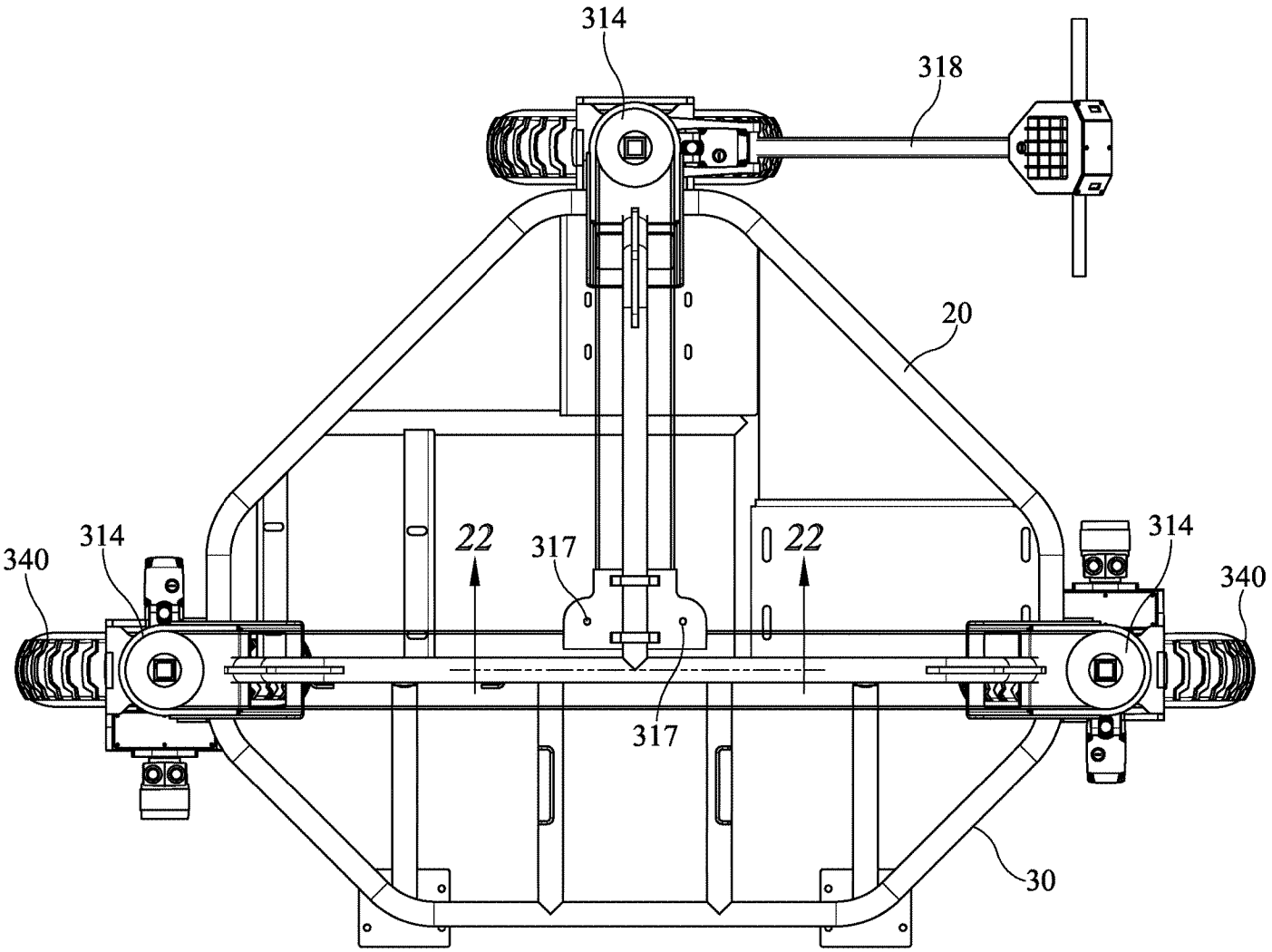
FIG. 12 is top view of a concrete screed frame and drive assembly in accordance with one embodiment of the present invention.

In further embodiments wheel mounts 330 and wheels are 340 capable of swiveling or turning around a central vertical axis such that each wheel 340 may both rotate and swivel. As best seen in FIGS. 1 and 12, for example, in certain embodiments leveling legs 310 each include a gear 314 journaled thereon that rotates with leveling legs 310. The plurality of gears 314 may be secured together through engagement with a chain or belt 316, or the equivalent thereof, such that when a one of said legs 310 rotates each leg 310 rotates in a corresponding fashion. In some embodiments chain or belt 316 may be routed through a plurality of pulleys or gears 317 to facilitate the routing and movement thereof without impeding the operation and function of other components of apparatus 10.

In some embodiments a steering handle 318 may be secured to a one of said plurality of leveling legs 310, such that rotating steering handle 318 causes each of the plurality of leveling legs 310 to rotate, thus moving all wheels 340 together. As can be readily seen this embodiment of the invention permits a user or operator to easily turn and maneuver screed 10 by a simple rotation of steering handle 318. Since all wheels 340 are turned together in this embodiment, as best depicted in FIGS. 12-19 apparatus 10 can readily be moved in any direction by simple rotation of steering handle 318.

In a further embodiment of the invention chain 316 may be omitted so that only the wheel 340 that is secured to the leveling leg 310 that is controlled by steering handle 318 is manually turned. In this embodiment of the invention the remaining wheels 340 are free to turn as needed and simply follow along as the steered wheel 340 is used to turn and control screed apparatus 10. In a yet further embodiment of the invention, the non-steered wheels 340 may be disconnected from the steered wheel 340 by simply removing a clevis pin or like fastener from gears 314 on leveling legs 310, thereby disconnecting those leveling legs 310 from the steering-linked leg or legs 310.

In some embodiments the number and positioning of legs 310 around frame 20 of screed apparatus 10 may be varied without departing from the scope of the present invention. While the drawing Figures depict three leveling legs 310 secured to frame 20 it will be understood that a plurality of leveling legs may be employed in apparatus 10 without departing from the scope of the invention. Furthermore, leveling assembly 300 may in some embodiments comprise a plurality of actuators 320 secured to leveling legs 310 and leveling mounts 36 or sleeves 312 that are operable to force slidable leg 310 upwardly or downardly in sleeve 312 to thus elevate or lower frame 20 with respect to a reference plane, thereby leveling the entire screed apparatus 10 as a unit. Actuators 320 may include an input operatively coupled to an output 210 of controller 200, said output 210 being representative of a position or height of frame 20 and thus the grade setting of screed head assembly 100, since screed head assembly 100 moves in concert with frame 20. This feature of the instant invention provides an extremely level finished concrete surface, since the entire concrete screed apparatus 10 is continuously leveled with respect to a desired reference plane.

In yet further aspects and embodiments, actuators 320 may comprise hydraulic cylinder 320 that extend and retract o provide vertical adjustment to legs 310. In these embodiments an electrically actuated hydraulic valve having an input responsive to an output 210 of controller 200 is provided to route pressurized hydraulic fluid to hydraulic cylinders 320 thereby retracting or extending legs 310 and raising or lowering screed apparatus 10. In other embodiments, actuators 320 may comprise electrically operated actuators 320 of many varieties, including linear actuators and gear driven actuators. In embodiments where leveling system 300 is electrically actuated, screed 10 does not require a hydraulic system including a hydraulic pump 162 or manifold 164, thereby further reducing the total weight of apparatus 10, which is advantageous in upper deck pour applications. In these embodiments electrical actuators 320 may have an input operatively coupled to an output 210 of controller 200, said output 210 being representative of a position or height of frame 20 and thus the grade setting of screed head assembly 100. Furthermore, electrically operated actuators 320 may include an output or outputs representative of leveling leg 310 position operatively coupled to an input 220 of controller 200, thereby providing positive feedback of leveling leg 310 position to controller 200. In one exemplary but non-limiting embodiment actuators 320 may comprise linear actuators that include an electric motor to drive a gear set and thus extend or retract leveling legs 310. Linear actuators 320 can include various inputs and outputs that are operatively coupled to the inputs 220 and outputs 210 of controller 200, such that controller 200 may quickly and accurately control the extension and retraction of leveling legs 310 as set forth herein below.

In various aspects and embodiments wheels 340 may be driven by either hydraulic or electric motors 350, mounted on wheel mount 330 and controlled responsive to an output 210 operatively coupled to controller 200. Motors 350 may be hydraulic motors supplied with pressurized hydraulic fluid through operation of pump 162 and manifold 164. Alternatively motors 350 may be one of many commercially available electric motors, for example a direct drive DC motor or the like, depending upon the power source 150 being utilized with screed apparatus 10.

In one embodiment of the invention each wheel 340 is driven by an independent motor 350. Furthermore, in another embodiment of the invention only the wheel or wheels 340 proximate the rear frame 40 are driven by a motor or motors 350, such that the other wheels 340 are free to rotate and simply follow driven wheel 340. In various embodiments motors 350 are controlled via outputs 210 from controller 200 responsive to an input 220 to controller that is supplied by operator interface 240. For example, a joystick, a plurality of pushbuttons, handle mounted triggers, a track pad, or a touch screen may be provided for a user to provide input commands to controller 200 indicative of a desired rotation of a driven wheel or wheels 340 so that motors 350 are energized to turn wheels 340 responsive to a user's commands. In some aspects and embodiments, and as seen in FIG. 1, for example, a user interface 240 may be mounted or secured on steering handle 318 to be readily accessible while screeding a concrete pour. In other embodiments, user interface 240 may be provided as a remote smart device, for example a smart phone or tablet in wireless communication with controller 200 without departing from the scope of the invention. In the wireless remote control user interface 240 embodiment an operator may be positioned away from the screed apparatus 10 for safety as well as a reduction in weight on the deck area being poured. In each of these embodiments all screed 10 functions may be operated through interface 240.

Figure 13:
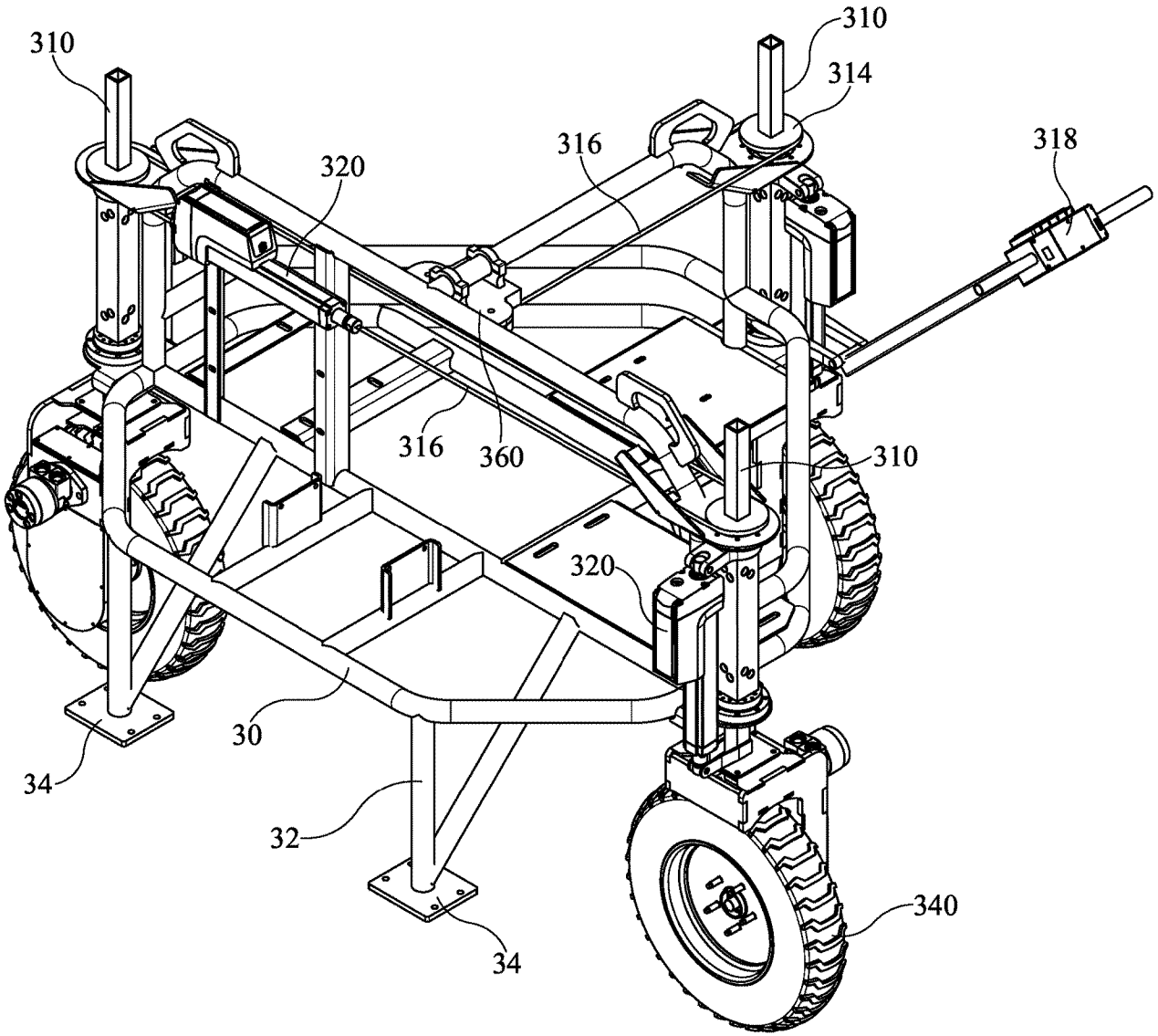
FIG. 13 is a perspective view of a concrete screed frame and drive assembly in accordance with one embodiment of the present invention.
Figure 15:
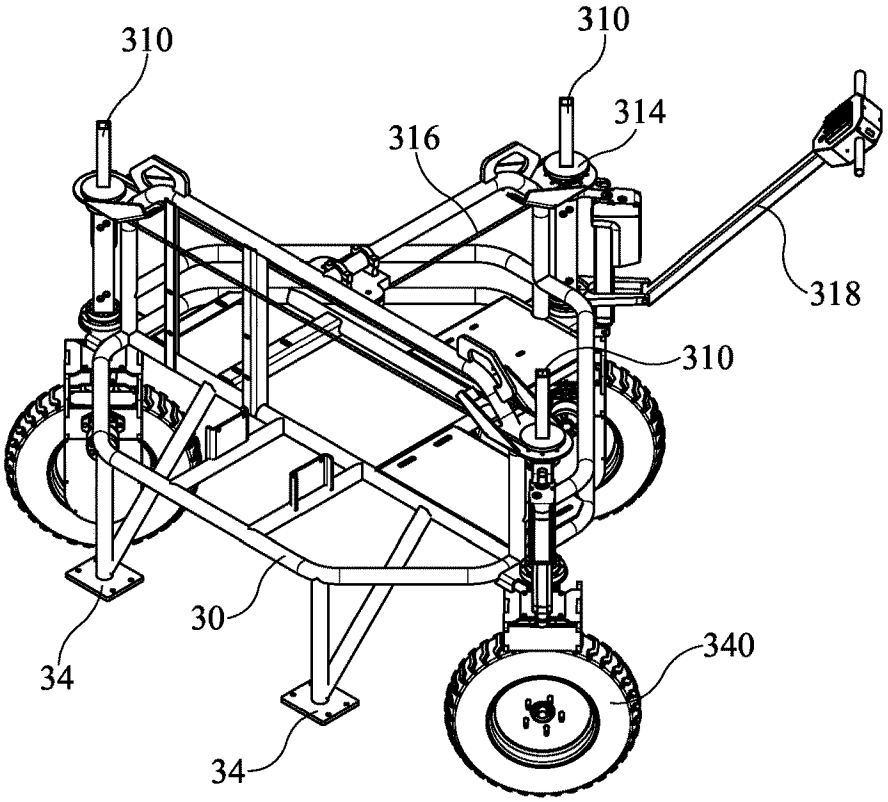
FIG. 15 is a perspective view of a concrete screed frame and drive assembly in accordance with one embodiment of the present invention.
Figure 14:
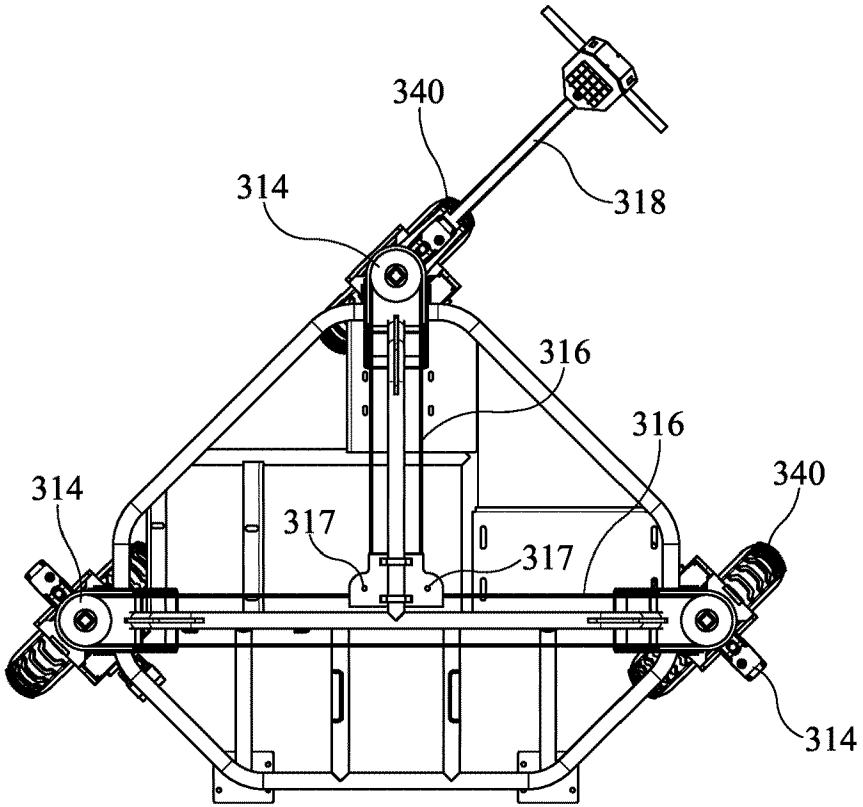
FIG. 14 is top view of a concrete screed frame and drive assembly in accordance with one embodiment of the present invention.
Figure 17:
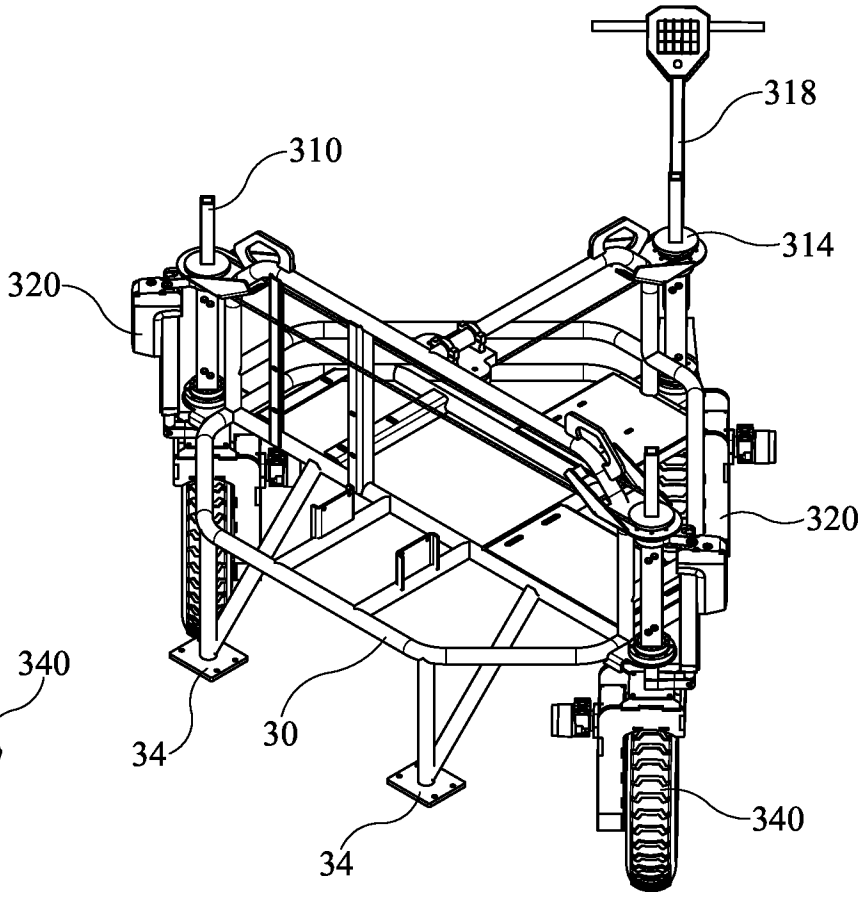
FIG. 17 is a perspective view of a concrete screed frame and drive assembly in accordance with one embodiment of the present invention.
Figure 16:
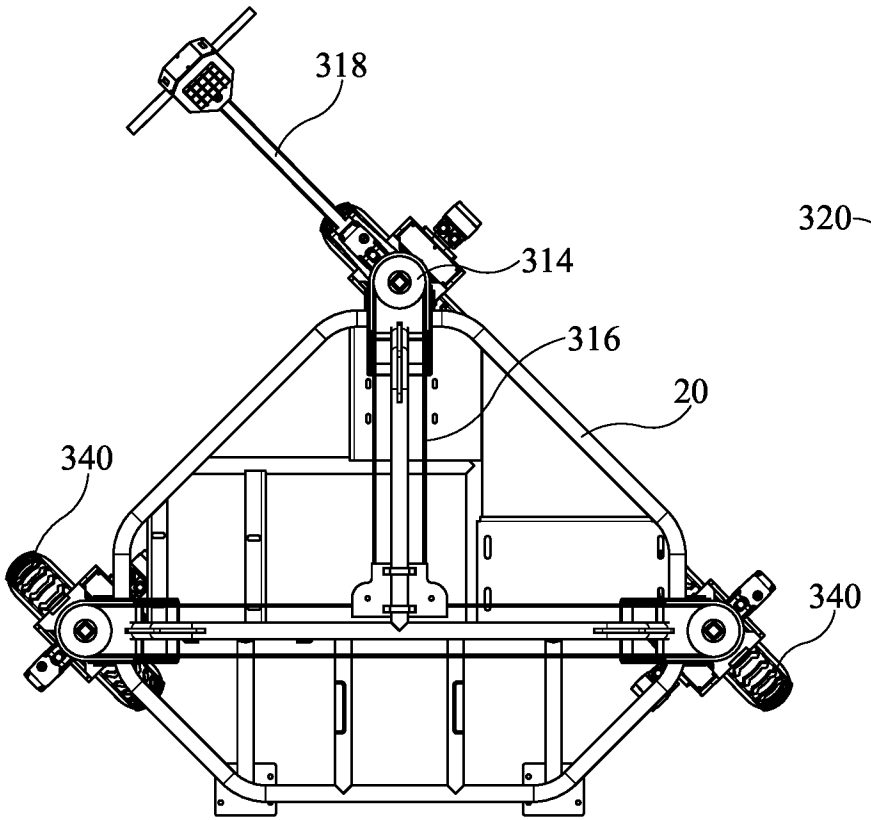
FIG. 16 is top view of a concrete screed frame and drive assembly in accordance with one embodiment of the present invention.
Figure 19:
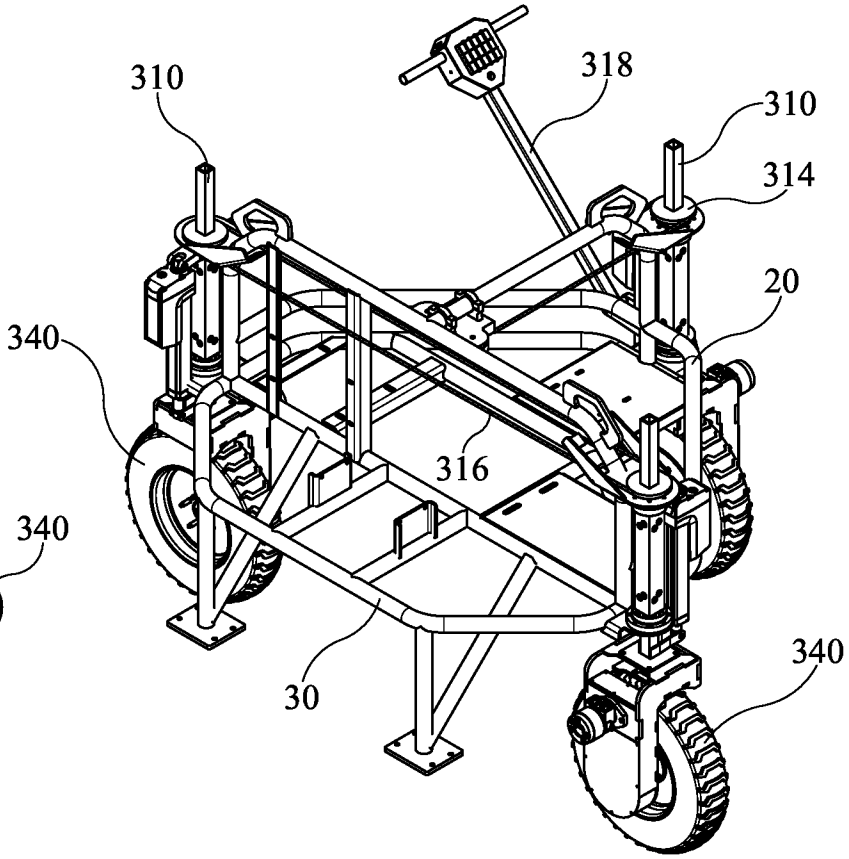
FIG. 19 is a perspective view of a concrete screed frame and drive assembly in accordance with one embodiment of the present invention.
Figure 18:
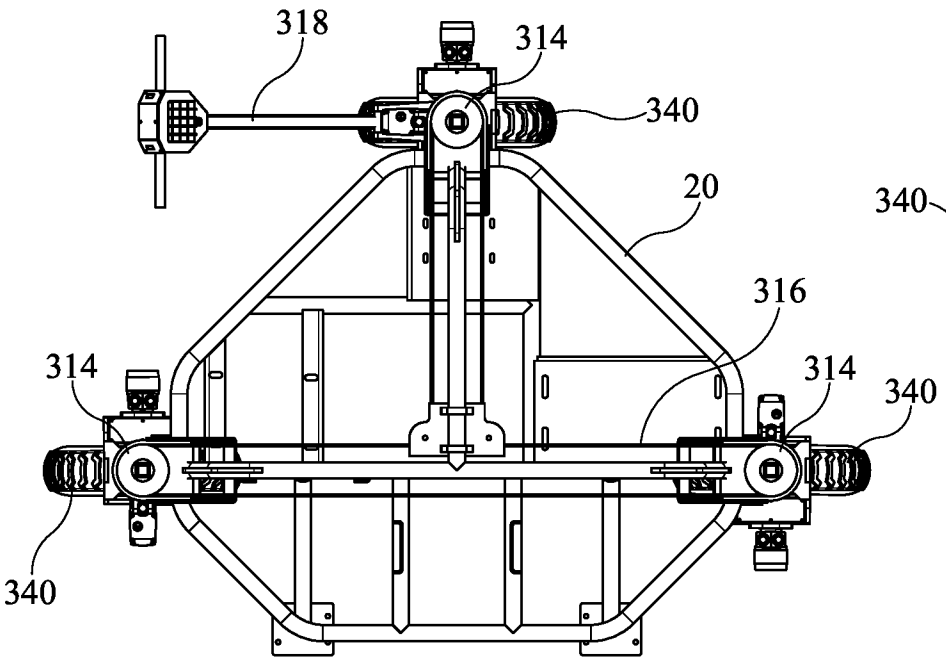
FIG. 18 is top view of a concrete screed frame and drive assembly in accordance with one embodiment of the present invention.
Figure 21:
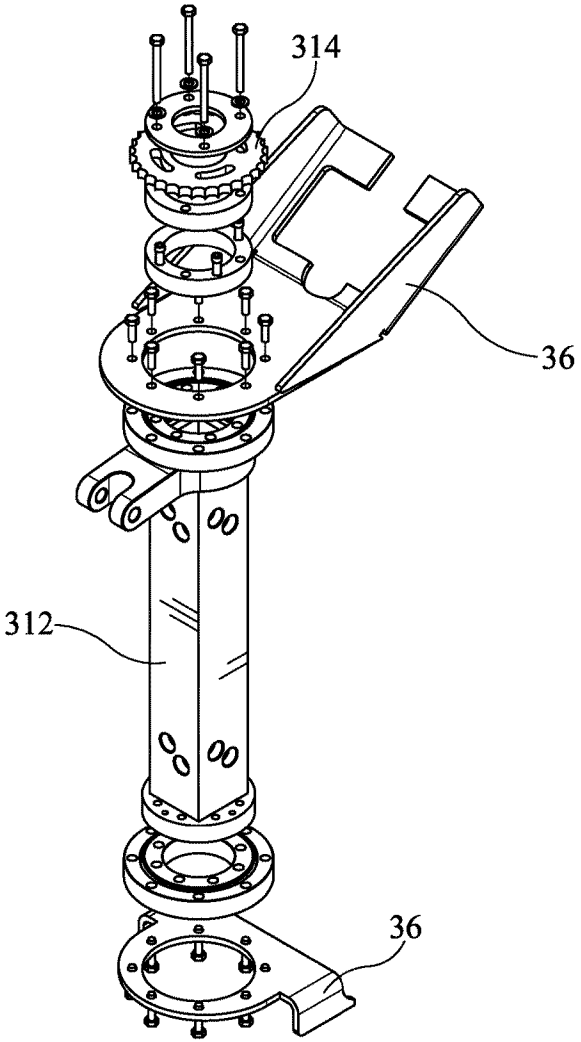
FIG. 21 is a perspective view of a leg assembly in accordance with one embodiment of the invention.
Figure 20:
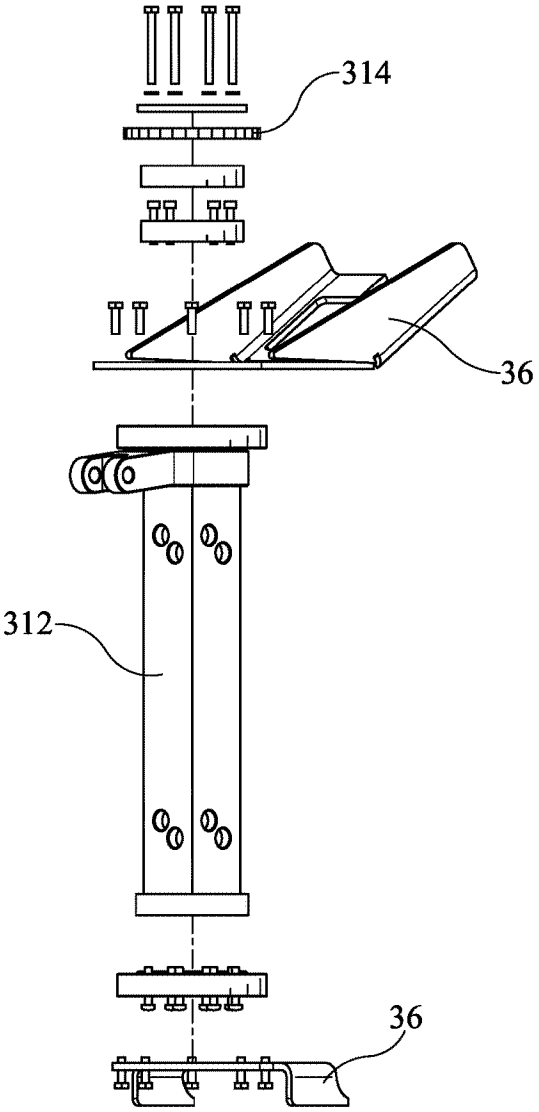
FIG. 20 is an elevation view of a leg assembly in accordance with one embodiment of the invention.
Figure 22:
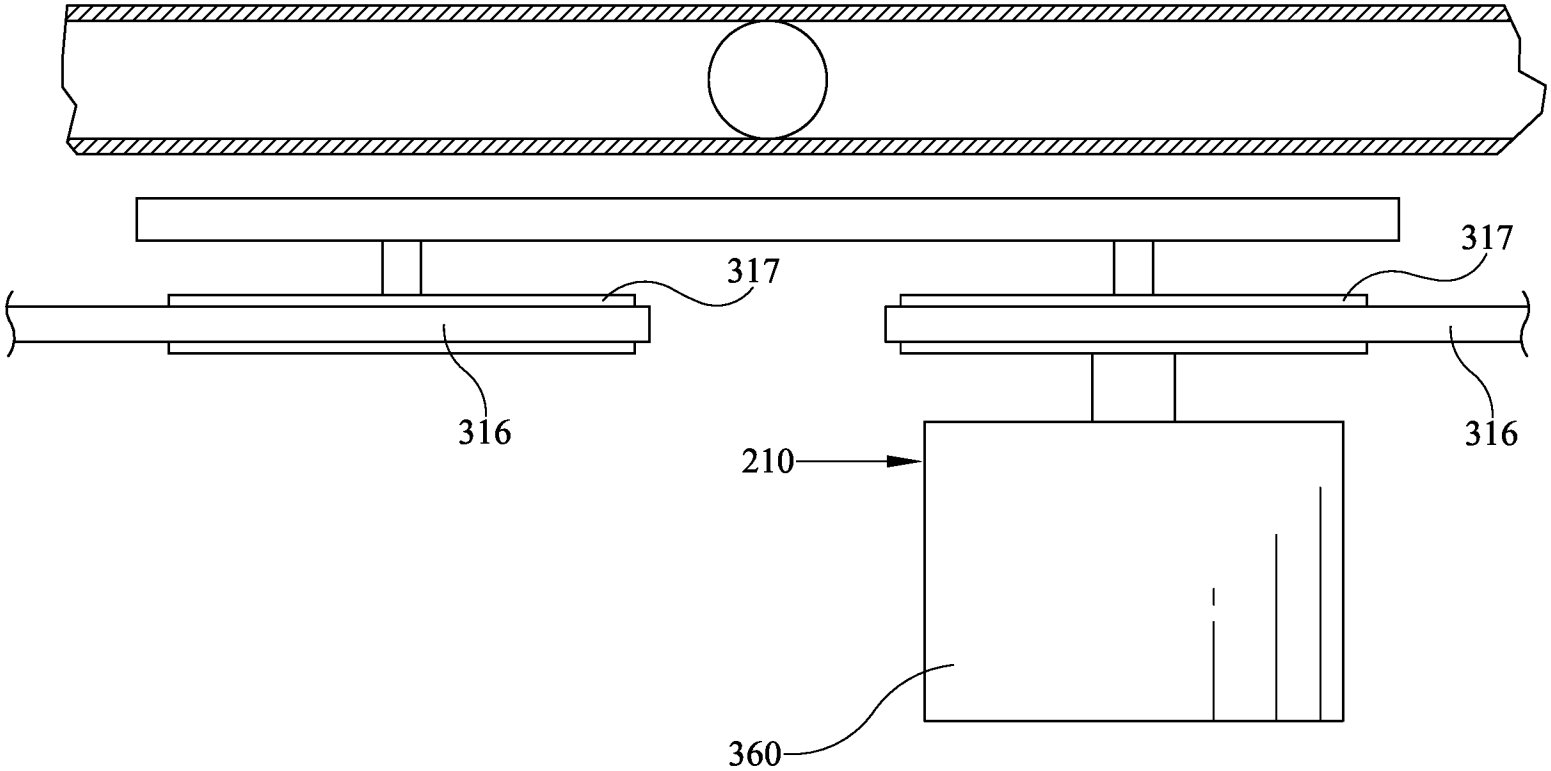
FIG. 22 is a partial elevation view taken along the line 22-22 of FIG. 12

The steering system for screed 10 may in some embodiments also be operated electro-mechanically and/or hydraulically such that wheels 340 may be rotated at least 90 degrees from "forward", thereby providing screed 10 the ability to move sideways or parallel to the pour as best seen in FIGS. 12, 13 and 22. For example, as depicted in FIG. 22 a steering motor 360, either electric or hydraulic, may drive a gear 317 that engages chain 316 and thus turns leveling legs 310 and concomitant wheels 340 in any desired direction. Motor 360 may be controlled by an output 210 from controller 200 responsive to an input 220 to controller 200 that is supplied by operator interface 240. In this embodiment of the invention, a user may provide a command via operator interface 240 to control both the direction of wheel 340 turn and rotation, thereby providing a screed apparatus 10 that may be completely controlled remotely by a user.

In some aspects and embodiments as shown in FIG. 13, a linear actuator 320 may be secured at a point to frame assembly 40 or sleeve 312 and also to chain or belt 316. By operating actuator 320 responsive to an output 210 from controller 200 responsive to an input 220 to controller 200 that is supplied by operator interface 240, actuator 320 can effectively steer apparatus 10 by simply retracting or extending actuator 320. In some aspects and embodiments chain or belt 316 is tensioned such that extending actuator 320 allows wheels 340 to turn in a first direction while retracting actuator 320 allows wheels 340 to turn in a second direction. In further aspects and embodiments linear actuator 320 may be provided with an output 210 from controller 200 that is representative of a "center" position for wheels 340 thereby permitting an operator to precisely straighten wheels 340 for a screeding pass.

As depicted in FIGS. 12-19 the combination of at least one or a plurality of driven wheels 340 that may or may not be linked by chain 316 and steering to turn together provides the ability for screed apparatus 10 to be driven directly horizontally (or at a 90 degree angle to the general screed direction) so that the machine may be easily moved horizontal to a pour. In fact, screed apparatus 10 can be moved in virtually any direction, and is capable of "crabbing", or moving in virtually any direction. This feature of the invention is also particularly advantageous for maneuvering screed apparatus 10 through narrow doorways or other restricted space areas as required in many interior concrete pours.

In various embodiments as best seen in FIGS. 1-6, a plurality of leveling system 400 may include a plurality of laser leveling eyes 402 may be mounted to screed head assembly 100, for example on a post or upright 404 secured or fastened at either end of screed head 100 to level screed 10. Furthermore, a slope sensor 410 may also be secured to screed apparatus 10 proximate rear frame 40 such that the front/rear tilt of the screed head 100 may be detected thereby. Leveling eyes 402 have outputs operatively coupled to an input 220 of controller 200, said outputs being representative of an elevation with respect to a reference plane. Similarly, slope sensor 410 also has an output operatively coupled to an input 220 of controller 200, said output representative of the front-to-back slope or "tilt" of the screed apparatus 10. Since screed head assembly 100 is rigidly secured to frame 20, by adjusting rear leveling leg or legs 310 the front-to-back tilt of screed apparatus 10 can be adjusted. In various embodiments controller 200 monitors both slope 410 and level 402 outputs and automatically adjusts leveling legs 310 to provide apparatus 10 with a predetermined elevation and tilt.

In various embodiments, screed 10 has a three-point leveling system 400, wherein the screed may be leveled side-to-side by adjusting the opposed outer legs 310 responsive to the laser eyes 402 with respect to a reference plane, and then titled front to back by adjusting the rear leg 310 with respect to the slope sensor 410. In some embodiments of leveling system 400, a sonic leveling system such as a sonic tracker or similar distance measuring device, a global positioning system (GPS) or a local positioning system (LPS) or any other three dimensional control system may be employed in place of laser eyes 402, and provide elevation feedback to an input 220 of controller 200 for leveling screed apparatus 10 without departing from the scope of the invention. In some embodiments controller 200 levels screed apparatus 10 by initially monitoring the outputs from laser eyes 402 and then supplying the appropriate outputs to actuators 320 to adjust front leveling legs 310. Controller 200 then monitors the output from slope sensor 410 and supplies the required output to actuator or actuators 320 of rear leveling legs 310 to adjust the tilt of screed apparatus 10. Controller 200 may then iterate these two leveling steps at predetermined intervals to monitor and maintain a consistent grade setting for screed apparatus 10 while screeding, thereby providing a level finished concrete surface.

In other aspects and embodiments system 10 may incorporate geo-fencing mapping that tracks and monitors screed 10 position utilizing a 3D positioning system, thereby enabling screed 10 to be operated without operator input for predetermined pours or jobs.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," "secured," and "mounted," and variations thereof herein are used broadly and encompass direct and indirect connections, couplings, and mountings. In addition, the terms "secured" and "mounted" and variations thereof are not restricted to physical or mechanical connections or couplings.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

We claim:

1. An apparatus for screeding uncured concrete to produce a level finished surface comprising:

a frame assembly having a screed head secured directly thereto for contacting said concrete, whereby vertical movement of said frame assembly effects vertical movement of said screed head;

a leveling assembly secured to said frame assembly at a plurality of points, having a plurality of vertically adjustable leveling legs capable of extension and retraction;

a controller having a processor, a data memory, and a plurality of inputs and outputs for receiving and accepting signals;

a leveling assembly control for providing a grade setting for said frame assembly and said screed head; and a plurality of driven wheels secured to said leveling legs at a lower end thereof, each of said wheels capable of rotation around a vertical axis for steering said apparatus, whereby said leveling assembly control establishes a grade level of said screed head by leveling said frame as said apparatus is driven through said uncured concrete.

2. An apparatus as claimed in claim 1 comprising:

a hybrid internal combustion and electric power system.

3. An apparatus as claimed in claim 1 wherein said leveling assembly control includes at least one of a plurality of laser leveling eyes, a global positioning system, a three-dimensional control system and a sonic tracker.

4. An apparatus as claimed in claim 1 comprising:

a plurality of hydraulic cylinders secured to said leveling legs for extension and retraction thereof.

5. An apparatus as claimed in claim 1 comprising:

a plurality of electrically powered actuators secured to said leveling legs for extension and retraction thereof.

6. An apparatus as claimed in claim 1 wherein said leveling assembly comprises:

three leveling legs secured to said frame assembly, wherein an opposed pair of said leveling legs are positioned near opposed ends of said frame assembly, and wherein a third leveling leg is positioned proximate a rear of said frame assembly, thereby providing a three-legged leveling system.

7. An apparatus as claimed in claim 6 comprising:

a steering handle connected to said wheel mounted on said third leveling leg whereby the direction of any or all of said wheels is controlled by said steering handle.

8. An apparatus as claimed in claim 6 wherein said opposed pair of leveling legs adjusts said screed head elevation responsive to a sensed reference plane, and where said third leveling leg adjusts said screed head slope responsive to a sensed angle.

9. An apparatus as claimed in claim 1 wherein said screed head assembly consists of at least one of a fixed height plow, an auger, a roller, and a finish blade.

10. An apparatus as claimed in claim 1 wherein said frame and said leveling legs are comprised substantially of aluminum.

11. An apparatus as claimed in claim 1 wherein said frame and said leveling legs are comprised substantially of carbon fiber.

12. An apparatus as claimed in claim 1 comprising:

an internal combustion engine for supplying power to said apparatus.

13. An apparatus as claimed in claim 1 comprising:

a battery powered electrical system for supplying power to said apparatus.

14. An apparatus as claimed in claim 13 where said battery powered electrical system includes rechargeable batteries.

15. An apparatus for screeding concrete to produce a level finished surface comprising:

a screed head assembly having at least one member for smoothing concrete secured thereto, said screed head assembly secured directly to a frame assembly;

a controller having a processor, a data memory, and a plurality of inputs and outputs for receiving and accepting signals; and a leveling assembly secured to said frame assembly at a plurality of points, said leveling assembly having three leveling legs capable of extension and retraction, and at least one of a plurality of laser leveling eyes, a global positioning control system, and at least one sonic tracker for monitoring and providing a grade setting and a slope setting for said screed head by leveling said frame as said apparatus moves through said concrete; and a plurality of driven wheels secured to said leveling legs at a lower end thereof, each of said wheels capable of independent driven rotation around a horizontal axis for steering said apparatus.

16. An apparatus for screeding concrete to produce a level finished surface as claimed in claim 15 comprising:

a power source for powering said leveling assembly and said driven wheels.

17. An apparatus as claimed in claim 16 wherein said power source comprises an internal combustion engine.

18. An apparatus as claimed in claim 16 wherein said power source comprises an electrically operated system.

19. An apparatus as claimed in claim 18 where said electrically operated system includes batteries.

20. An apparatus as claimed in claim 16 wherein said power source comprises a hybrid engine.

21. An apparatus as claimed in claim 16 further comprising:

a steering system provided to at least one of said wheels for turning said apparatus.

* * * * *